United States Patent [19]

Wilson

[11] 4,136,465

[45] Jan. 30, 1979

[54] TOBACCO BULK CURING CONTAINER SECTIONS AND COMPOSITE BARN CONSTRUCTION FORMED THEREBY

[75] Inventor: Robert W. Wilson, Charlotte, N.C.

[73] Assignee: Powell Manufacturing Company, Inc., Bennettsville, S.C.

[21] Appl. No.: 758,921

[22] Filed: Jan. 13, 1977

Related U.S. Application Data

[63] Continuation-in-part of Ser. No. 649,674, Jan. 16, 1976, abandoned.

[51] Int. Cl.[2] ..... A24B 1/06

[52] U.S. Cl. ..... 34/210; 34/233; 34/236; 52/122; 52/745; 56/27.5; 214/1 H; 214/5.5; 220/1.5; 294/5.5; 432/500

[58] Field of Search ..... 214/1 H, 1 R, 1 N, 5.5; 294/5.5; 34/93, 225, 240, 233, 210, 236; 131/140 R; 56/27.5; 52/745, 122; 220/23.4, 1 S; 432/500

[56] References Cited

U.S. PATENT DOCUMENTS

| | | | |
|---|---|---|---|
| 288,243 | 11/1883 | Kendall | 34/4 |
| 3,664,034 | 5/1972 | Wilson | 34/225 |
| 3,935,959 | 2/1976 | Long | 432/500 X |

*Primary Examiner*—Frank E. Werner
*Attorney, Agent, or Firm*—Cushman, Darby & Cushman

[57] ABSTRACT

A tobacco bulk curing barn construction including a furnace section and a plurality of portable barn sections each having imperforate side walls and top wall that form substantially complete exterior walls and roof of an integral transverse section of a composite curing part of the barn construction. Flanges and sealing gaskets are provided along edges of each section to provide sealing engagement of adjacent sections in a series row formation. A screen is secured across one end of the barn section to define with the side walls a full section open curing space for receiving tobacco filled in bulk therein when the section is disposed flat on the screened end. A pair of open frames is mounted between the side walls for movement from open positions after an initial amount of tobacco has been filled into position on top of the leaves to limit the amount of compression which can subsequently be applied to the initial tobacco by virture of the subsequent full loading of leaves into the curing space. A pair of cross frames is pivoted to the side walls at the end opposite the screen for pivoting from open positions during tobacco loading into closed tobacco retaining positions across the end of the section. U-shaped tines each having a pair of legs and a connecting base are inserted into the bulk tobacco and are supported in tobacco supporting position by the tip ends of the tines projecting into the screen and the base ends of the tines being supported on the cross frames. The screen, cross frames, and tines combine to support tobacco in the full section of the full width of the barn and the full height except for air circulation voids at the top and bottom when the section is joined with other sections to form a composite barn.

37 Claims, 24 Drawing Figures

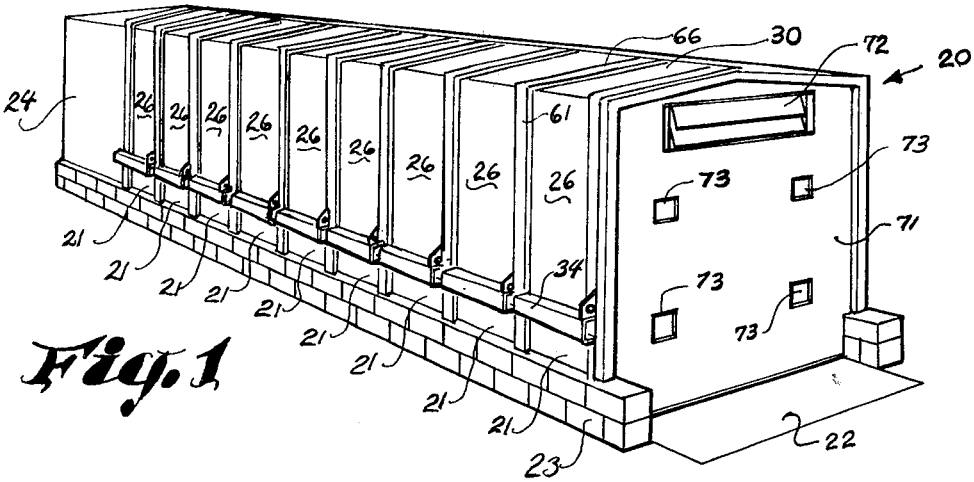
Fig. 1
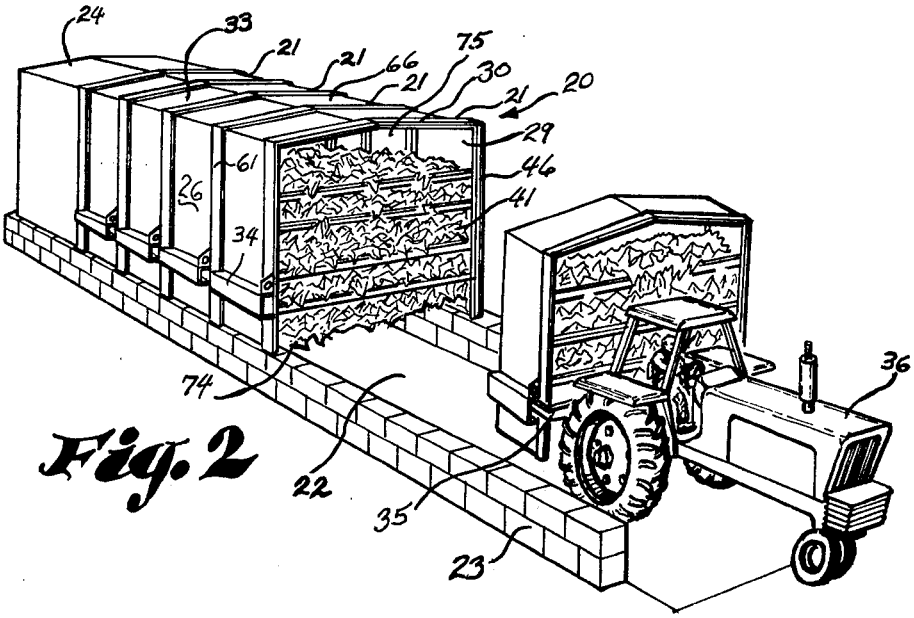
Fig. 2
Fig. 3
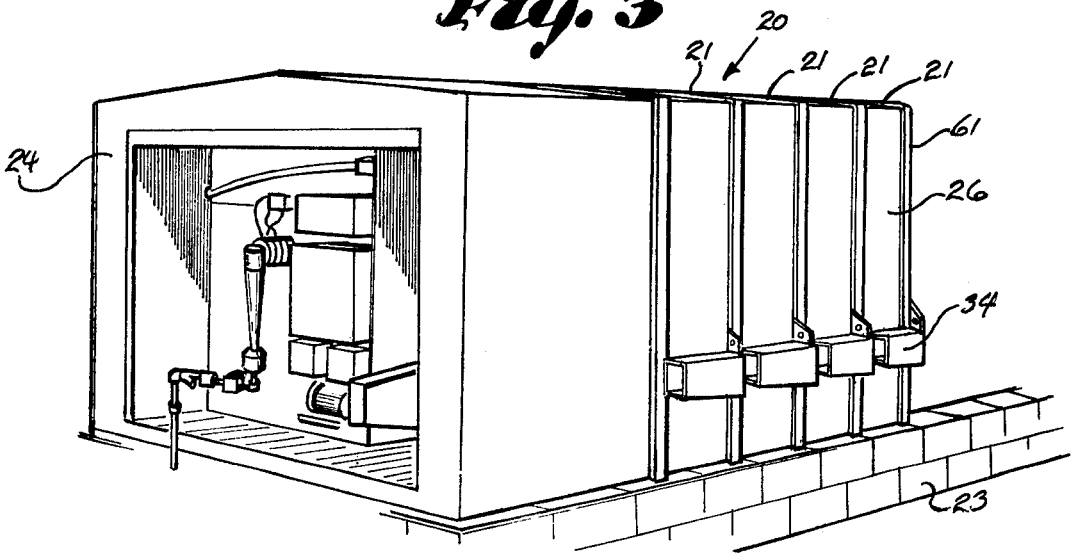

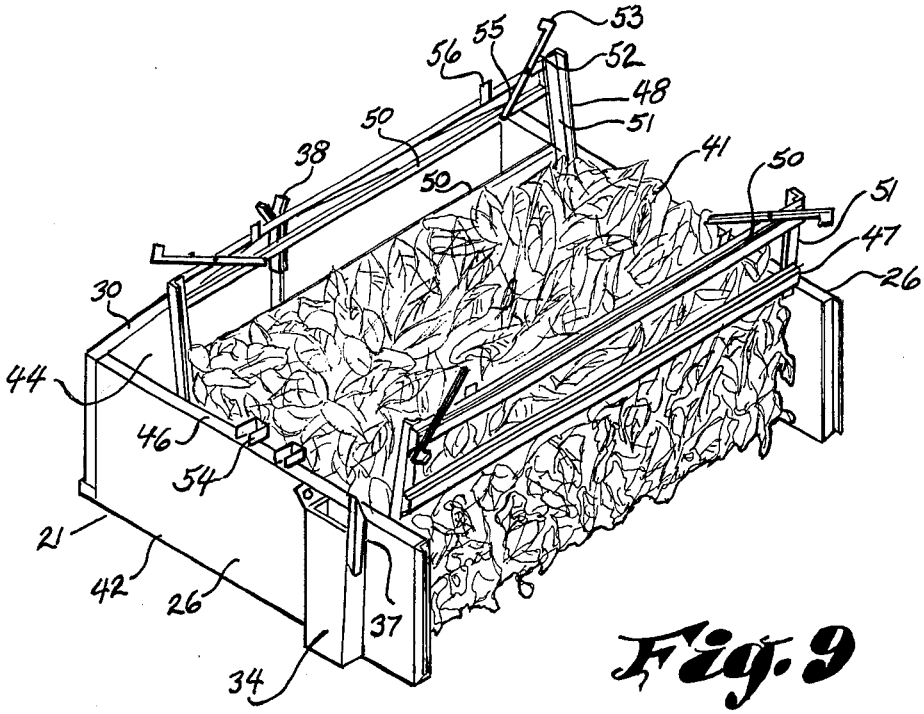
Fig. 9
Fig. 10
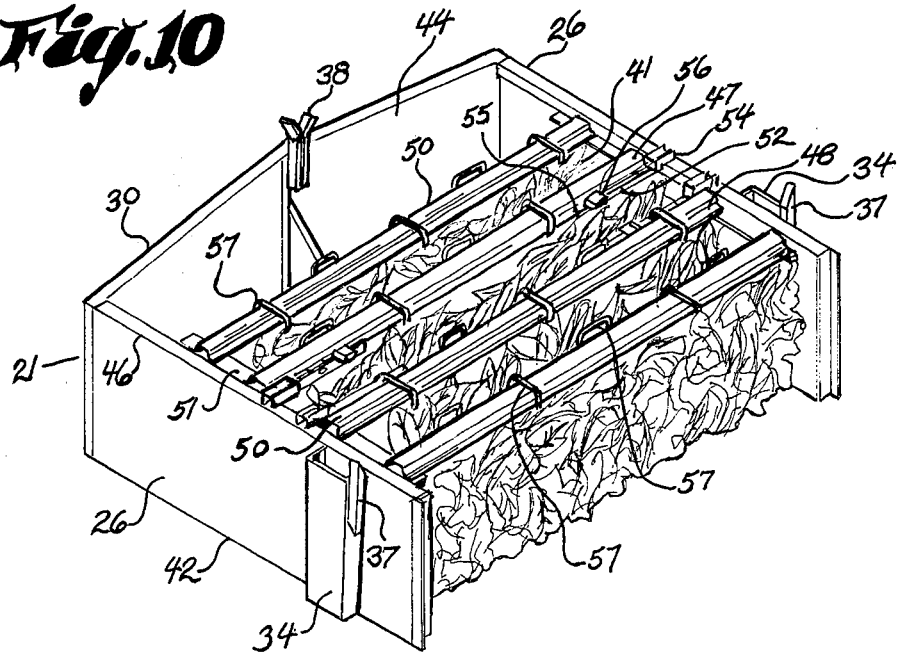

Fig. 14
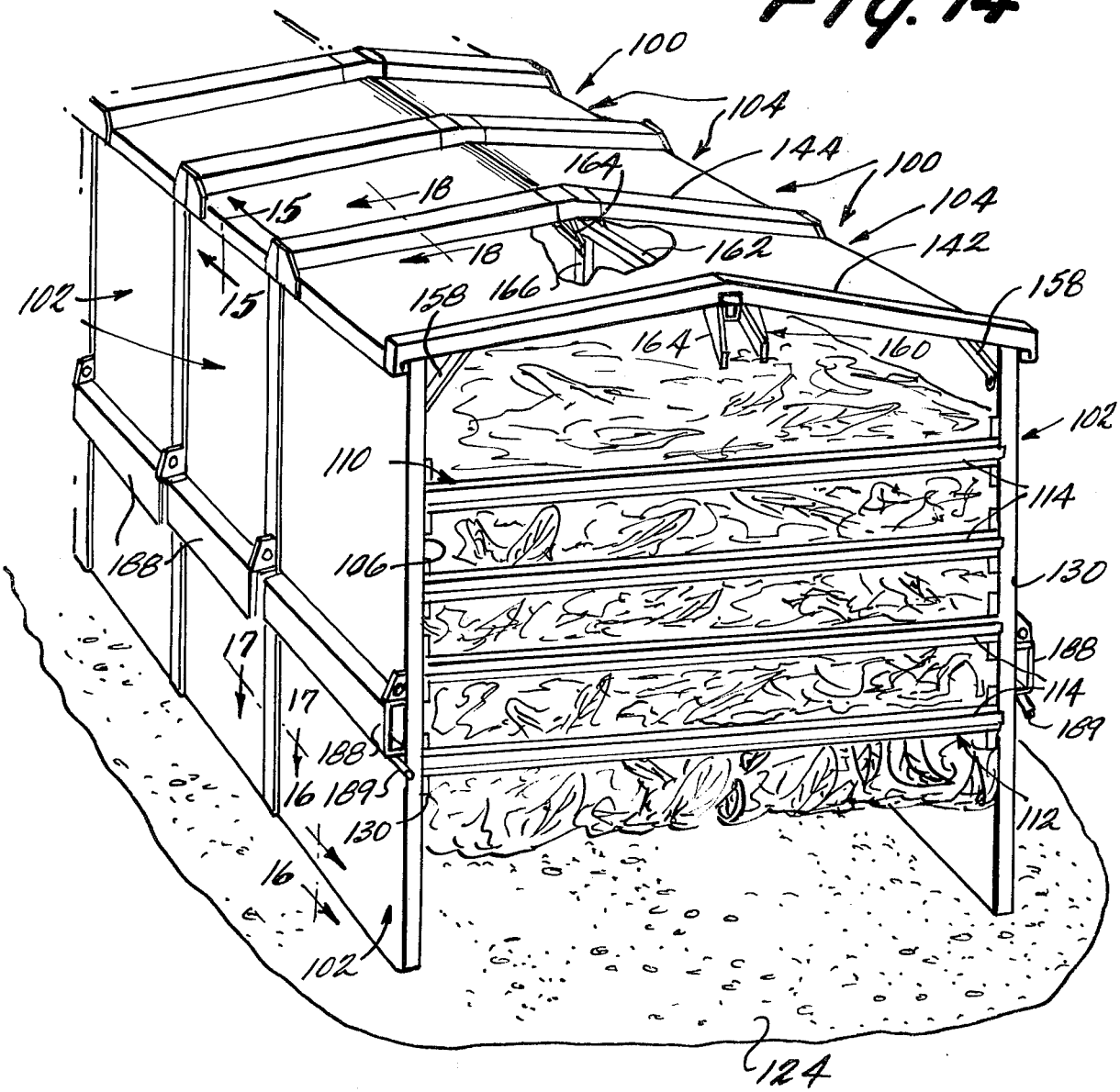
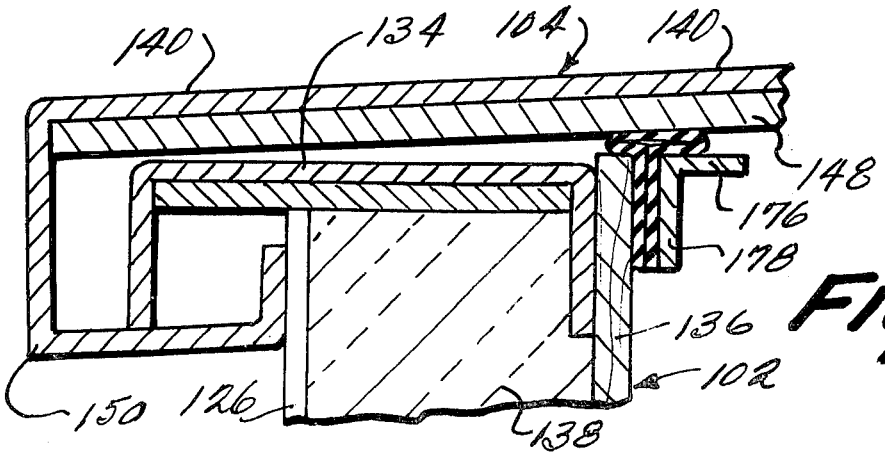
Fig. 15

100
102
104
106
110
112
114
130
132
160
162
164
170
188
189
190
192
194
196
198
200
206
222
224

TOBACCO BULK CURING CONTAINER SECTIONS AND COMPOSITE BARN CONSTRUCTION FORMED THEREBY

RELATED APPLICATION

This application is a continuation-in-part of application Ser. No. 649,674, filed Jan. 16, 1976, which is now abandoned.

BACKGROUND OF THE INVENTION

The present invention relates to a bulk tobacco curing barn composed of individual barn sections, and more particularly to a portable barn section that serves both as a substantially full exterior transverse section and as a bulk tobacco supporting container of substantially full barn section extent.

Bulk curing of flue-cured tobacco is presently preferred because of the advantages of economy and uniformity of curing as compared with curing of hand strung tobacco on poles, and it is particularly advantageous as it is readily adaptable to mechanized harvesting racking and handling.

In the conventional bulk process tobacco is harvested from plants by mechanical harvesters that deposit the harvested tobacco leaves into open trailers that are transported from the fields to racking areas at which the tobacco leaves are transferred manually into individual racks that bind the tobacco leaves together in a bulk mass for curing support in a permanent full enclosure barn. With racks of conventional size there are usually two longitudinal rows of racks arranged with each extending between and supported by one side wall of the barn and a center partition support. Each row has racks disposed in three tiers with the tobacco in the longitudinally adjacent racks and vertically adjacent racks being contiguous to produce uniform curing air circulation from a bottom chamber in the barn below the racked tobacco up through the tobacco to a top longitudinal chamber above the tobacco. Temperature and humidity controlled air is circulated through the barn from a furnace section at one end. Examples of this type of barn and rack arrangement are disclosed in my prior U.S. Pat. Nos. 3,664,034, issued May 23, 1972; and U.S. Pat. No. 3,927,683, issued Dec. 23, 1975.

This conventional two row, three tier rack arrangement requires six racks to fill the transverse area of the barn, and as each of these racks must be handled individually in being transported from the racking area to the barn and into the barn to its proper position, considerable labor, primarily manual labor, is required for this aspect of the process even though overall the process is greatly less laborious than the old pole strung process.

Attempts have been made to minimize the labor involved in racking and in handling racks, and to reduce the amount and cost of the barn structure and the racks required for each barn loading. For examply, my U.S. Pat. No. 3,083,517, issued Apr. 2, 1963, discloses racking of tobacco directly on a harvester in full width and half barn height racks that are individually and separately inserted in portable barn sections carried by the harvester and subsequently transported from the harvester to assemble with similar barn sections to form a composite barn structure. The size of these barn sections is limited to allow for transportation on a harvester, and there is no reduction in the structure of the overall barn and rack arrangement as each barn section is simply a cross-section of a conventional barn and individual racks are still required.

In my later U.S. Pat. No. 3,134,583, issued May 26, 1964, there is disclosed a special rack structure that has ends constructed to form increments of composite barn side walls and nestable vertically and horizontally to combine to form a composite barn after assembly of a roof structure on top of the racks. However, as each rack is of the same general pin supporting type as conventional racks with resulting height limitations, a multiplicity of racks is required to assemble a full size barn, thereby resulting in significant handling and assembling complications.

Attempts have also been made to effect structural and handling economics using conventional permanent barn structures and simply enlarging the size of racks so that less racks are needed for each barn. See, for example, U.S. Pat. No. 3,834,137, issued Sept. 10, 1974; U.S. Pat. No. 3,935,959, issued Feb. 3, 1976; and U.S. Pat. No. 3,948,553, issued Apr. 6, 1976. Each of these patents discloses a single rack occupying the cross section of the barn and slidably supported between the permanent barn walls. However, such large size racks are difficult to handle and particularly require special handling and effort in assembling in the barn. As a result there are size limitations that result in limiting the size of the barn, and reinforced supports are needed to support and allow sliding of the racks along the barn walls.

In contrast to all of the foregoing attempts, the portable barn section construction of the present invention provides a full transverse barn section that has a full extent tobacco supporting space and structure formed integrally therein with the walls of the section serving economically and for light weight both as exterior barn walls and as tobacco retaining walls. Thus, a single integral light-weight and structurally simple tobacco retaining and barn forming section of full transverse extent is provided without requiring a multiplicity of units for each transverse section or separate racks or sliding support for racks, and despite being a full transverse section it is easily and economically loaded, assembled with other sections into a composite barn for a curing operation and subsequently disassembled for unloading.

Furthermore, in each of the above-described prior constructions the racks included frames with tobacco engaging pins rigidly secured thereto in sufficient number to support the tobacco in the racks. In relatively large size racks these pin frame arrangements require special alignment and care in insertion to avoid improper insertion and in addition are cumbersome and require an insertion force difficult to provide manually. In contrast, the present invention provides individual U-shaped tines that can be easily inserted in position manually without alignment problems, are easily supported in position, and are shaped to provide spaced support and to be limited in insertion for proper positioning.

In U.S. Pat. No. 3,935,959, noted above, which discloses the utilization of a bulk curing container in excess of a normal or conventional bulk curing rack, there is also disclosed the provision of a perforated partition or divider in the center of the wider-than-normal container for the purpose of preventing the leaves from flopping over and attaining an attitude which would block the passage of air therethrough during curing. The disclosed partition is preferably in the form of a chain link fence suspended along its upper edge during the curing operation. During loading, the suspended chain link fence partition is swung into a position within the container overlying an initial quantity of leaves loaded in the container. When the partition has been thus positioned, the initial leaves are compacted by an attendant or attendants walking on the partition until the leaves therebelow are compacted. Thereafter a second or final quantity of leaves is loaded onto the partition.

Applicant has found that rather than to provide a flexible structure intermediate the width of the container for purposes of enabling the initially loaded leaves to be compacted thereby, there is a need under certain circumstances (e.g. when sand lugs are being cured) for the provision of a rigid structure intermediate the container width to limit the amount of compression which can be applied to the initially loaded leaves by the structure itself and the subsequently loaded leaves.

The inherent compressibility characteristics of sand lugs and other leaves taken from near the bottom of the stalk differ significantly from the compressibility characteristics of leaves taken from near the top of the stalk. Sand lugs are usually larger and contain much more water than top leaves. In terms of compressibility, sand lugs tend to lack the springiness and thickness of top leaves. Consequently, when sand lugs are filled to a substantial depth within a large container, the leaves on the bottom of the container tend to become overly compacted due to the weight of the leaves lying thereon. When top leaves are loaded in the same container, the leaves in the bottom do not exhibit the same tendency to become overly compacted since the weight of the overlying leaves is less and there is more inherent springiness in top leaves to resist such compaction.

When curing sand lugs and the like, the utilization of a compression limiting structure in the middle of the container is therefore highly desirable in order to retain an acceptable uniformity in the bulk density of the loaded leaves. The partition of the aforesaid prior art patent does not provide a compression limiting function, rather its function is such that during loading its weight must be borne by the lowermost leaves in the container in addition to the weight of the overlying leaves.

SUMMARY OF THE INVENTION

Briefly described, the portable section of a tobacco curing barn of the present invention includes a pair of opposed imperforate side walls spaced apart to provide components of exterior side walls of a composite tobacco curing barn. The side walls extend substantially the full height of the composite barn to form substantially complete walls of a full transverse section of a composite barn. In addition, the side walls define an open space therebetween for receiving tobacco loaded in bulk therein when the section is disposed generally flat on one end thereof and means are engageable with the bulk tobacco loaded in the space for retaining the tobacco therein when the section is disposed upright. The side walls also have means along their exposed edges for releasably and sealingly engaging abutting edges of the walls of adjacent similar transverse barn sections upon assembly of a plurality of sections to form a composite bulk tobacco curing barn. Thus the portable sections are capable of being moved from a separate tobacco loading disposition to an upright disposition for assembly with other similar sections to form a composite tobacco curing barn for curing of the tobacco loaded and supported therein.

Preferably, the barn section also includes an imperforate top wall connected to and extending between the side walls substantially the full width of the composite barn to provide a full transverse component of the exterior roof of the composite tobacco curing barn. It is also preferable that the aforesaid means engageable with the bulk tobacco includes tobacco supporting means extending across at least a portion of one end of the barn section between the side walls and defining therewith an open space therebetween, with the tobacco supporting means receiving and supporting tobacco loaded in bulk in the space when the section is disposed in a loading position generally flat on the one end thereof. This tobacco supporting means may be perforate to permit air circulation and for the same reason may be spaced from the top wall to provide a curing space therebetween.

In order to limit the amount of compression applied to the initial leaves filled into the curing space when sand lugs and the like are being utilized, there is provided a pair of open frames which is pivotally and slidably mounted between the side walls for movement from an open loading position into a position overlying an initial amount of leaves filled in the curing space. The mounting of the open frames is such that as further leaves are filled thereon the added weight thereof will cause the open frames to move downwardly thus compacting or compressing the initial leaves, however, the mounting is such that the amount of downward movement of the open frames is limited and hence the amount of compaction or compression which can be applied to the initial leaves is likewise limited.

The sealingly engaging means may include an offset flange extending along one end edge of each side wall and projecting therefrom for overlapping the opposite end edge of the side wall of an adjacent barn section, and an upstanding flange may extend along one edge of the top wall with a downwardly shaped flange extending along the opposite end edge of the top wall to project longitudinally therefrom for engagement over the upstanding flange on the edge of the top wall of an adjacent barn section. To effect full sealing, resilient gasket material may be secured along at least one end edge of the section for sealing engagement with the opposite end edge of an adjacent barn section.

In the preferred embodiment, the tobacco engageable means includes a pair of cross frames positionable across the space and pivotably secured to the side walls adjacent opposite edges of the space for pivoting between open positions for allowing loading of tobacco into the space and closed positions over said space for retaining loaded tobacco therein with means releasably securing the cross frames in closed positions.

Also, in the preferred embodiment, the means engageable with the bulk tobacco includes individual members in the form of U-shaped tines insertable into the tobacco in the space in a general end-to-end direction with respect to the section to retain the tobacco in the space when the section is disposed upright. These U-shaped tines have legs insertable into the bulk tobacco and a base joining the legs to provide spacing of the legs and to limit insertion of the legs into the tobacco. The free ends of the tines extend through the tobacco to the aforesaid tobacco supporting means, which may be in the form of screen material into which the legs extend for support, and the bases of the tines may be supported by cross bars of the aforesaid cross frames with at least some of the tines straddling the cross bars.

The aforesaid tobacco supporting means may include cross supports, with the supports being staggered with respect to the cross bars of the cross frames for engagement of tobacco extending from the space of an adjacent section to prevent vertical voids between sections interiorly of an assembled barn.

Manipulation for handling, assembling and disassembling of the barn sections is facilitated by a pair of channels secured exteriorly to opposite side walls of the barn section for receipt of a fork lift when the section is disposed upright.

BRIEF DESCRIPTION OF THE DRAWINGS

FIG. 1 is a perspective view of a composite tobacco curing barn formed by assembling a plurality of portable tobacco curing barn sections according to the preferred embodiment of the present invention;

FIG. 2 is a view similar to FIG. 1 showing a partially assembled barn with a barn section in the process of being assembled therewith;

FIG. 3 is a perspective view of the furnace section end of the barn of FIG. 1 with the end door removed;

FIG. 9 is a perspective view of one of the barn sections of FIG. 1 shown lying flat on its end in a loading position with the cross frames open for loading;

FIG. 10 is a view similar to FIG. 9 showing the cross frames closed and U-shaped tines inserted in the tobacco therein;

FIG. 14 is a view similar to FIG. 1 illustrating barn sections embodying certain modifications and desirable optional features;

FIG. 15 is an enlarged fragmentary sectional view taken along the line 15—15 of FIG. 14;

DESCRIPTION OF THE PREFERRED EMBODIMENT

Figure 4:
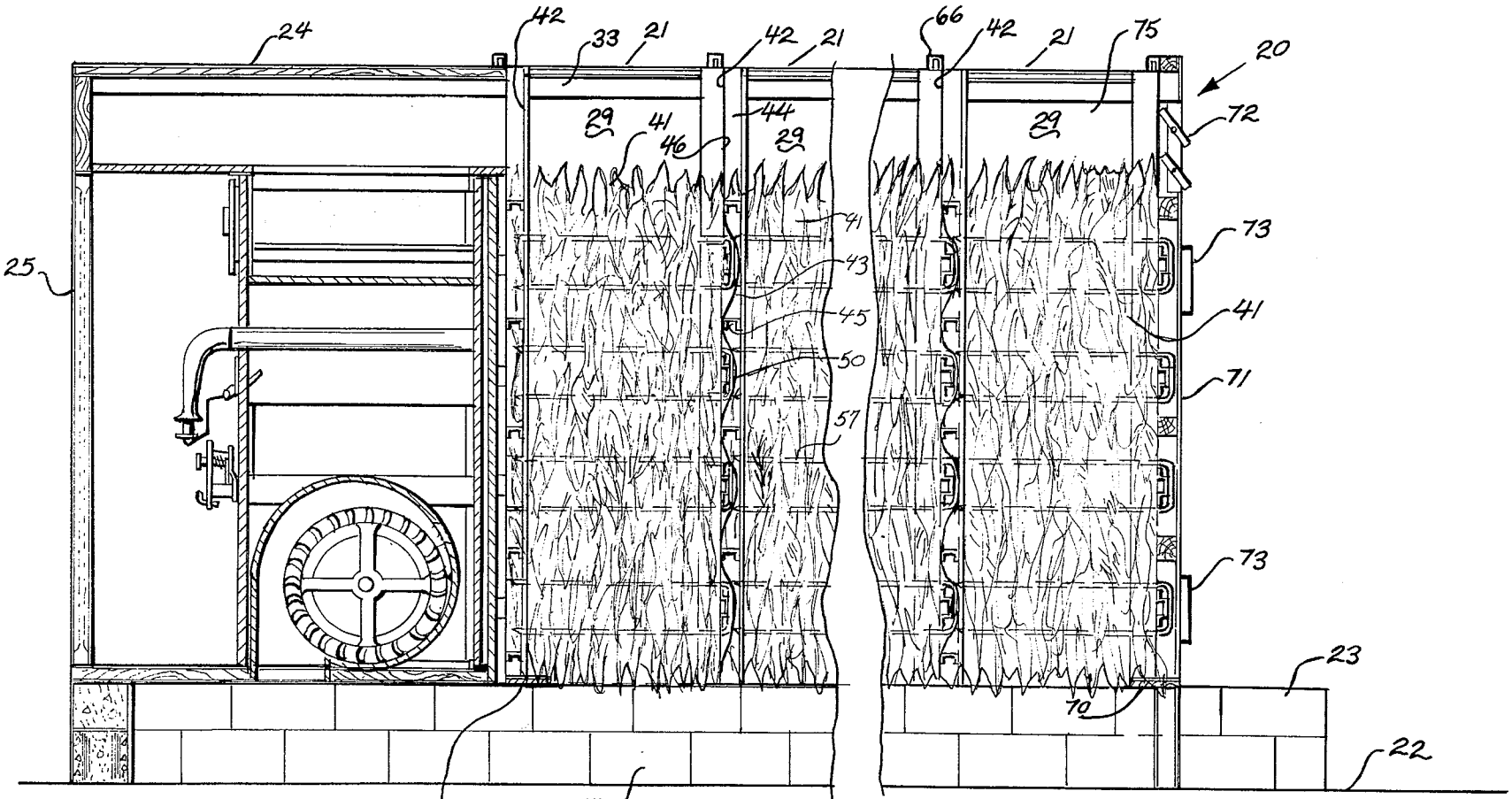
FIG. 4 is a partially broken away vertical section of the barn of FIG. 1 taken along the longitudinal center line thereof.
Figure 6:
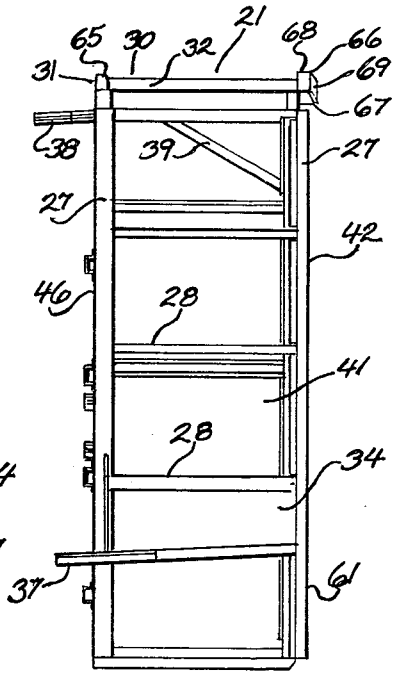
FIG. 6 is a side elevation of the right side of the barn section of FIG. 1 with the wall panels removed.
Figure 5:
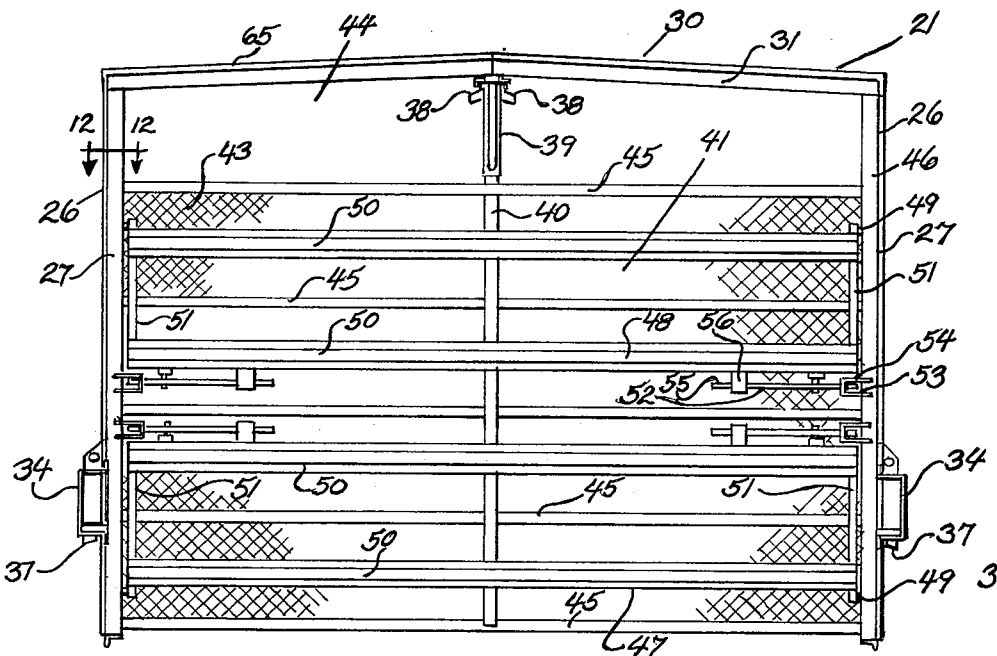
FIG. 5 is an end elevation of one of the barn sections of the barn of FIG. 1.
Figure 8:
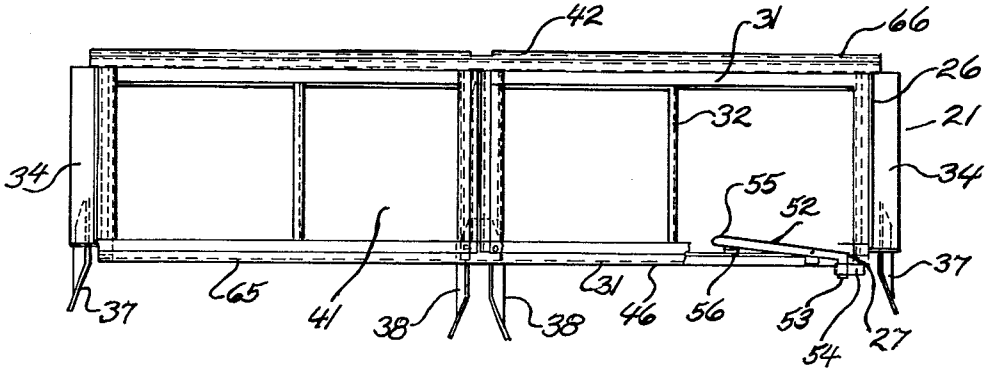
FIG. 8 is a top plan view of the barn section of FIG. 5 with the top wall panels removed.
Figure 7:
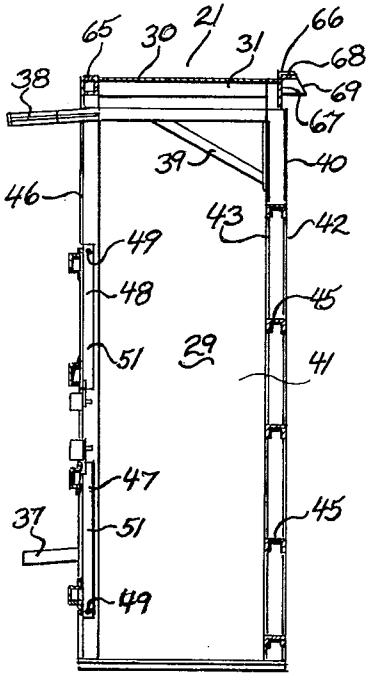
FIG. 7 is a vertical section taken along the longitudinal center line of the barn section of FIG. 5.
Figure 11:
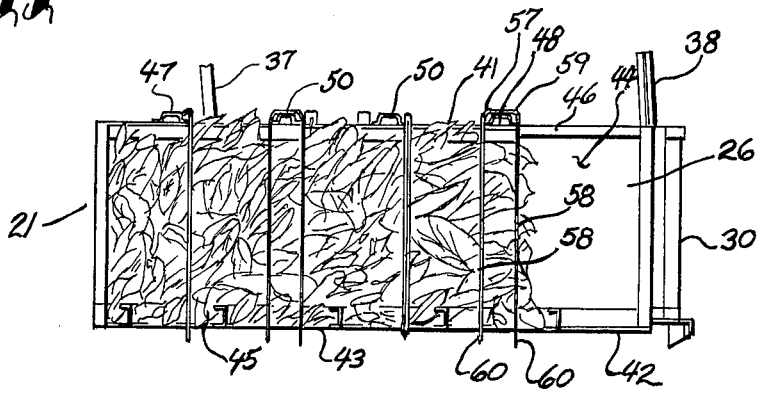
FIG. 11 is a vertical section taken along the longitudinal center line of the barn section of FIG. 10.

Referring first to FIG. 1 of the accompanying drawings, a bulk tobacco curing barn 20 is shown as a composite construction assembled from a plurality of individual transverse barn sections 21 mounted on a concrete floor 22 with a low concrete block wall 23 extending along the periphery of the floor 22 at the sides and one end thereof for support of the barn sections 21 thereon. At the end of the barn 20 at which the concrete block wall 23 extends, a furnace section 24 is mounted, as shown more particularly in FIG. 2 with its end door 25 (FIG. 4) removed for illustration of the general arrangement of the interior thereof. This furnace section 24 contains a conventional arrangement for circulating air of controlled temperature and humidity through the barn 20. The details of such an arrangement are disclosed in my aforesaid U.S. Pat. No. 3,664,034 and U.S. Pat. No. 3,927,683.

As illustrated in FIGS. 5-12, each barn section 21 includes a pair of opposed side walls 26 spaced apart substantially the full width of the barn 20 and extending vertically substantially the full height of the barn section 21 from the block wall 23 to the top of the barn. These side walls have vertical end posts 27 and cross framing members 28 for strength and rigidity, and they are each covered by panels 29 containing insulating material and providing an imperforate extent to the side walls 26.

Connected rigidly to and extending between the side walls 26 is a top wall 30 that has end framing members 31 and cross framing members 32, and is, like the side walls 26, covered by an imperforate insulating panel 33 (FIG. 2). In the embodiment illustrated, the top wall 30 is formed in halves divided longitudinally along the center line thereof so that each half can be preassembled with its associated side wall for nesting with other similar subassemblies for convenient and economical storage and shipping prior to job site assembly into a complete barn section. The halves are connected by bolts or welding in final assembly with the connection and arrangement of parts being such as to form the top wall 30 as a slightly peaked roof.

In this arrangement, the side walls 26 provide exterior walls for the barn section 21 and the top wall 30 provides an exterior roof for the barn section 21. As the side walls extend substantially the full height of the composite barn and the top wall extends substantially the full width of the composite barn, the side and top walls form substantially complete walls and roof of an integral transverse section 21.

Handling of the barn section 21 is accommodated by a pair of exterior channels 34 secured symmetrically along opposite side walls 26 at a level for engagement therein of a fork lift mechanism 35 on a tractor 36. These channels 34 taper from a wide opening at the front end of the barn section side walls 26 to a smaller dimension rearwardly for convenient receipt and guiding of the aforesaid fork lift 35.

To facilitate assembly of the barn sections 21 by guiding them in proper alignment during final assembly movement, a pair of flaring guide bars 37 is secured to the under side of the aforesaid channels 34 and extends forwardly of the side walls 26 for engaging the side walls of an adjacent barn section to position the adjacent section in proper assembly alignment. For the same purpose converging guide plates 38 are secured to the under side of the top wall 30 along the longitudinal center line thereof at the location where the halves of the top wall 30 are secured together. These converging guide plates 38 flare from forwardly projecting ends toward the center line under the top wall 30 and serve to engage and properly align the rear end of corresponding plates 38 of an adjacent barn section being assembled therewith. These converging guide plates 38 and the top wall 30 are strengthened by a diagonal brace bar 39 secured to the guide plates 38 intermediate the ends of the top wall 30 and to a vertical reinforcing post 40 depending from the inner end of the center of the top wall 30 with the brace bar 39 interconnecting the top wall 30 and reinforcing post 40 for reinforcement of both elements.

In addition to serving as exterior side walls of the barn section 21, the aforesaid side walls 26 serve to retain bulk tobacco within the barn section 21. In this regard, the side walls 26 define an open space 41 for receiving tobacco loaded in bulk therein when the barn section 21 is disposed generally flat on its inner end 42 (with respect to its disposition during assembly) and in which open space the tobacco is retained during curing in the composite barn 20.

In addition to the side walls 26 the tobacco is retained in the space 41 by means engageable with the bulk tobacco loaded in the space when the section is disposed upright. This means includes tobacco supporting means in the form of a metal screen 43 extending fully across the barn section 21 at the inner end 42 thereof and secured to the ends of the spaced side walls 26. This metal screen 43 extends vertically from substantially the bottom of the side walls 26 to a location spaced a sufficient distance below the top wall 30 to provide an upper void 44 to allow air circulation during curing. This metal screen 43 also allows some air passage horizontally as air is being circulated generally vertically between tobacco leaves and also, because it is screen material, is of some resiliency to allow compression against tobacco bulging from the adjacent barn section and thereby prevent any vertical voids from forming that could disrupt uniform air circulation through the tobacco in the barn. The metal screen 43 is reinforced by the aforementioned vertical reinforcing post 40 and by horizontal cross supports 45 secured at vertical spacings to the side walls 26 in contact with the metal screen 43.

When the barn section 21 is disposed generally flat on its aforesaid inner end 42, the cross supports 45 and metal screen 43 serve as a floor for receiving bulk tobacco loaded into the barn section space 41 and also serve to retain the tobacco in the space when the barn section 21 is upright in an assembled barn condition for curing.

Figure 12:
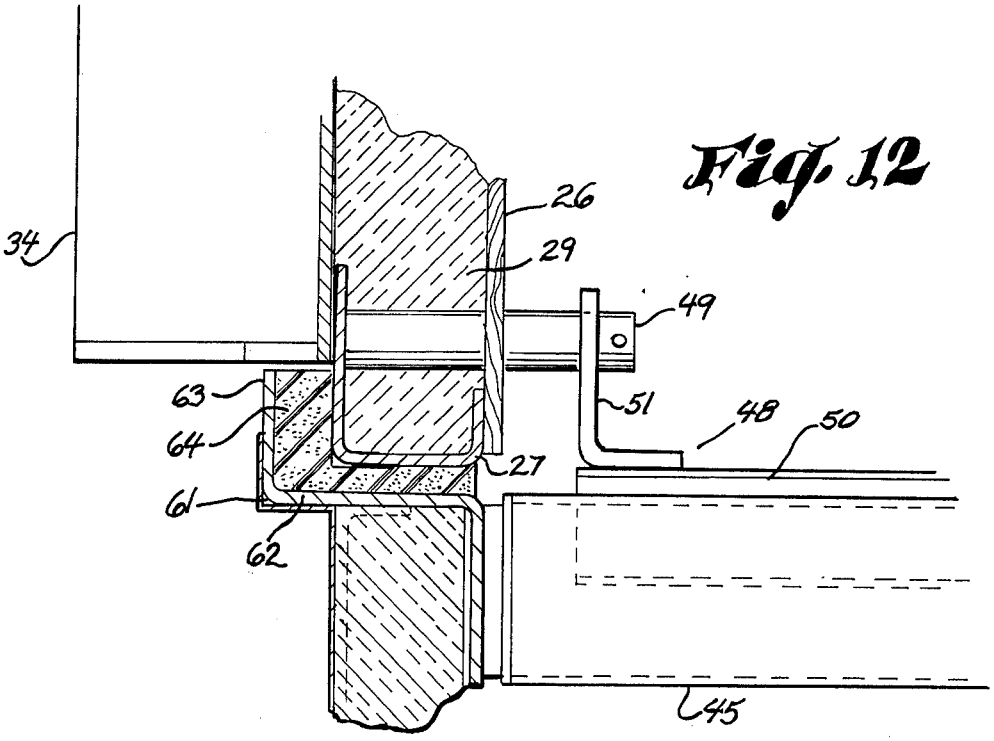
FIG. 12 is an enlarged horizontal section of the flange engagement of adjacent barn sections at a location on one of the barn sections as indicated by the lines 12—12 in FIG. 5.

Tobacco is retained at the outer end 46 of the barn section 21 by a pair of vertically spaced cross frames 47, 48, each extending across the outer end 46 and pivoted at its ends to opposite side walls 26 by pivot pins 49 (FIG. 12). Each cross frame 47, 48 includes a pair of spaced cross bars 50 secured to connecting bars 51 connected to the pivot pins 49 and extending parallel to and adjacent the side walls 26.

The lower cross frame 47 is pivoted to the side walls 26 adjacent the bottom thereof so that it can be pivoted to an upright disposition when the barn section 21 is disposed flat (FIG. 9) to confine tobacco being loaded into the space 41 to the desired limits of the space and not to prevent tobacco from being loaded therein. Similarly, the upper cross frame 48 is pivoted to the side walls 26 at the upper limit of the open space 41 approximately in line with the upper limit of the metal screen 43.

During loading the cross frames 47, 48 are disposed in open positions as shown in FIG. 9 to allow tobacco to be bulk loaded into the space 41, and upon completion of loading, the cross frames 47, 48 are pivoted to a closed position across the outer end 46 of the barn section 21 and against the tobacco therein.

The cross frames 47, 48 are retained in closed position by retaining means that include latch arms 52 pivoted to the cross bars 50 farthest spaced from the pivot pins 49. There are four latch arms 52, one pivoted at each end of the two outer cross bars 50 and each having an end with a latch finger 53 projecting outwardly therefrom for engagement under a U-shaped bracket 54 secured to the outer end of the adjacent side wall 26 and extending over the open space 41 slightly for receipt therein of the latch finger 53. The opposite end 55 of each latch arm 52 is engageable under a retaining finger 56 secured to and projecting from the cross bar 50 so that when the latch finger 53 is retained by the bracket 54 and the opposite end 55 of the arm is retained by the finger 56, the cross frames 47, 48 are locked against movement from the closed position. To allow for disengagement of the latch arms 52, the pivot connection is sufficiently loose to allow movement of the end 55 of the latch arm 52 away from the retaining finger 56 so that the latch arms can be pivoted out of bracket engagement. However, when the barn section 21 is loaded with tobacco it is filled to such an extent that there is considerable compression of the tobacco when the cross frames 47, 48 are moved to the closed position and the resulting tobacco pressure against the cross frames serves to retain the latch fingers 53 in latched position and some manual effort is required to move the end 55 of the arm away from the retaining finger 56 to open the latch.

The side walls 26, metal screen 43, and cross frames 47, 48 support the loaded tobacco in the open space 41 when the barn section 21 is disposed flat on its inner end 42 during loading, and these same elements retain the loaded tobacco in the space 41 when the barn section 21 is disposed upright for curing. However, these elements do not directly prevent the tobacco leaves from moving downwardly when the barn section 21 is upright and for this latter purpose the means engageable with the loaded tobacco includes individual members insertable into the tobacco in the space 41 in a general end-to-end direction with respect to the section. In the preferred embodiment these individual members are U-shaped tines 57 having legs 58 joined by a base 59 with the legs being of a length approximating the depth of the barn section 21 and being spaced apart by the base 59 to provide spaced insertion into the tobacco leaves in the open space 41, with the base 59 also serving to limit insertion of the legs 58 into the bulk tobacco in the space 41. These tines 57 are inserted from the outer end 46 of the barn section through the tobacco to the inner end 42, with the legs having ends or tips 60 that pierce the tobacco leaves and project into the metal screen 43, which engages and supports the tines and pierced tobacco leaves when the barn section 21 is upright. The use of a metal screen 43 simplifies the use of individual tines 57 as no special registry of the tine legs with the supporting structure is necessary, the tine tip 60 simply projecting into whatever screen opening it approaches when inserted.

Preferably, the tines 57 are inserted so that at least one leg 58 or the base 59 of each tine 57 is adjacent a cross bar 50 of the cross frames 47, 48 in position for support of the tines 57 by the cross bars 50 when the barn section 21 is upright. In this regard, some of the tines 57 may be disposed with their bases 59 parallel with and resting on the cross bars 50 and other tines 57 may be disposed in straddling relation to the associated cross bar 50 with the bases 59 of the tines 57 extending across the outer surface of the associated cross bar 50.

Figure 13:
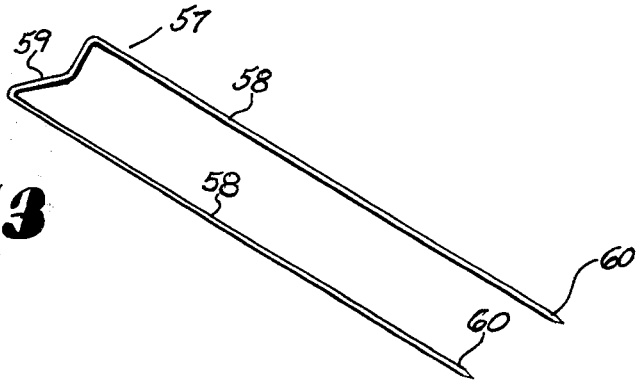
FIG. 13 is a perspective view of the U-shaped tine of the preferred embodiment of the present invention.

The use of these individual tines 57 allows for manual insertion of the tines at desired locations and avoids the need for any mechanical pin frame inserting apparatus. Also, due to the size of the barn sections 21, a pin frame having some type of cross structure and projecting tobacco engaging pins would be a large and cumbersome structure that could present a problem in terms of handling, aligning and registering insertion, and probably would require a mechanical means for insertion. The construction of the preferred embodiment of the tines 57 of the present invention is illustrated in FIG. 13 and the disposition of the tines in the tobacco is illustrated in FIGS. 4, 9 and 10. The spacing of the tines 57 is preferably such that most tobacco leaves in the space 41 are pierced by one or more tines 57 for distributed support of the mass of bulk tobacco in the space.

When the individual barn sections 21 are assembled the adjacent barn sections are in engagement in a manner that provides a sealing relation to form a closed barn without allowing significant escape of the forced air that is circulating within the barn to control the curing process. For this purpose the present invention provides means for sealingly and releasably engaging abutting edges of adjacent transverse barn sections 21. In the preferred embodiment, this means includes an offset flange 61 extending along the edge of each side wall 26 at the inner end 42 thereof. This offset flange 61 (FIG. 12) has a laterally projecting portion 62 from the outer edge of which a longitudinally projecting portion 63 extends beyond the end of the barn section 21 for overlapping the outer end 46 of the adjacent barn section 21. Also preferably, resilient gasket material in the form of a foam plastic strip 64 is adhered to the surfaces of the offset flange 61 that contact and overlap the adjacent barn section to provide a generally airtight seal. The aforementioned flaring guide bars 37 and converging guide plates 38 provide proper alignment of the offset flanges 61 with the adjacent barn section 21 so that the proper sealing and overlapping interengagement will be effected properly.

Sealing engagement between barn sections along the top walls 30 thereof is accomplished by this sealingly engaging means through the use of an upstanding flange 65 along the edge of the top wall 30 at the outer end 46 thereof and a downwardly shaped flange 66 extending along the edge of the top wall 30 at the inner end 42 thereof. This downwardly shaped flange 66 is generally U-shaped, having an upwardly extending portion 67, a longitudinally extending portion 68 that projects over the upstanding flange 65 of an adjacent barn section 21 and a downwardly extending portion 69 that overlaps the aforesaid upstanding flange 65. Gasket material 64 similar to that used along the side wall flanges 61 is also provided on the downwardly shaped flanges 66 of the top wall 30 for the same sealing purpose.

In using the barn sections 21 of the preferred embodiment of the present invention, they are individually disposed at a loading or racking station in flat disposition on the inner end 42 with the cross frames 47, 48 in open position. The tobacco can be loaded in bulk into the open space 41 manually, although it is preferable to use a mechanical distributing apparatus, such as is disclosed in my copending U.S. patent application Ser. No. 629,974, filed Nov. 7, 1975, entitled Tobacco Handling Apparatus. Other types of loading mechanisms could be used and it is also contemplated that the barn sections could be carried on a harvester for loading directly in the field during the harvesting operation. In any event, the barn section 21 is loaded to a level well above the edges of the side walls 26 so that there will be substantial compression of the bulk tobacco as the cross frames 47, 48 are pivoted to their closed positions. This provides a compact mass for uniform and restrained circulation of forced air therethrough during curing and also provides sufficient bulging of tobacco from the ends of the barn section for compressing against tobacco in adjacent barn sections to seal adjacent tobacco masses together without allowing any vertical voids that could disrupt the controlled air circulation.

After the cross frames 47, 48 are forced to their closed positions against the mass of bulk tobacco, the latch arms 52 are manipulated to engage the latch fingers 53 under the U-shaped brackets 54 and to engage the opposite ends 55 of the latch arms 52 under the retaining fingers 56, thereby latching the cross frames 47, 48 in closed position. The tines 57 are then inserted manually into the tobacco in relation to the cross bars 50 of the cross frame 47, 48 in the manner described heretofore, after which the filled barn section 21 may be pivoted by a hoist or supporting mechanism or frame of desired construction to an upright disposition. A tractor 36 can then pick up the upright barn section 21 by inserting a fork lift 35 into the tapered channels 34. The tractor 36 is then operated to carry the loaded barn section 21 to the barn foundation (FIG. 2) that has a furnace section 24 at its inner end. The tractor aligns the barn section 21 with the precedingly assembled barn section in a general alignment as it approaches the previously assembled barn section. In the final approach, the guide bars 37 and guide plates 38 guide the moving barn section 21 into position while the tractor holds the barn section slightly elevated to allow the downwardly shaped flange 66 along the top wall 30 of the moving barn section to pass over the upstanding flange 65 on the top wall 30 of the previously placed barn section 21. The tractor continues to move the barn section 21 into place until contact is made between the offset flange 61 along the side walls 26 of the moving barn section 21 and the face of the side walls 26 of the previously placed barn section 21. The tractor then lowers the barn section to allow engagement of the downwardly shaped flange 66 into overlapping sealing engagement with the upstanding flange 65 of the previously placed barn section 21. At this point the bottom of the side walls 26 comes to rest on the concrete block walls 23 and further slight lowering of the fork lift 35 releases it from support of the barn section 21 and allows removal of the fork lift 35 and tractor 36.

When the barn sections are assembled, as illustrated in FIG. 4, the bulging of the compressed mass of tobacco and the construction of the metal screen 43 in combination with the cross supports 45 in staggered relation to the cross bars 50 of the adjacent cross frames 47, 48 provide for sufficient contact between the bulging tobacco and the structure of the adjacent barn section to form an effective obstruction to the development of vertical voids that could disrupt controlled air circulation during curing. Also, to prevent the development of vertical voids, baffle plates 70 are placed across the barn under the inner end 42 of the first barn section and the outer end 46 of the last barn section, thereby preventing free vertical flow of air between the first barn section and the furnace section 24 and between the last barn section and the outer end wall 71. This outer end wall 71 (FIGS. 1 and 4) encloses the outer end of the last barn section 21 and has pivoted baffle plates 72 in its upper extent to allow air pressure adjustment within the barn, and has sliding access doors 73 to allow inspection of the curing condition of the tobacco in the barn 20.

As seen in FIG. 4, there is a bottom plenum chamber 74 extending the full length of the barn 20 below the tobacco in the spaces 41 and above the barn floor 22, and into which forced air of controlled temperature and humidity is circulated from the furnace section 24. This air travels upwardly through the supported tobacco leaves into a top plenum chamber 75 that also extends the full length of the barn 20 and is formed by the combination of the aforementioned upper voids 44 of each barn section 21. Air entering this top chamber 75 is drawn back to the furnace section 24 for recirculation as described, for example, in my aforesaid patents.

After the controlled curing operation has been completed in the composite barn 20, the individual barn sections 21 can be disassembled in the reverse operation of assembly and can be unloaded individually at an unloading station either manually or using a suitable mechanical arrangement, following which the barn section 21 is again available for loading.

Referring now more particularly to FIGS. 14–24, there is shown therein a barn section, generally indicated at 100, which embodies certain modified constructions in accordance with the principles of the present invention as compared with the barn section 21 previously described, and which has embodied therein certain optional features which have not been described in connection with the barn sections 21.

Each barn section 100 is similar to the barn section 21 previously described in that it includes a pair of side walls 102, which correspond with the side walls 26 previously described and a top wall 104, which corresponds with the top wall 30 previously described. As before, there is provided an open curing space 106 between the side walls 102 which corresponds with the open space 41 previously described. When the curing space is loaded with tobacco leaves, the barn section 100 is disposed in a horizontal loading position and the bottom area of the curing space is provided with a bottom structure 108 which has a construction similar to the construction previously described including the metal screen 43 and horizontal cross supports 45. The barn section 100 also is provided with top closure means for the curing space which is in a gate-like form and includes a pair of cross frames 110 and 112 similar to the cross frames 47 and 48. The cross frames 110 and 112 and associated structure are constructed in the same fashion as the cross frames 47 and 48 and thus include cross bars 114 similar to the cross bars 50. The cross frames are mounted on pivot pins 116 similar to the pivot pins 51 and each cross frame is provided with retaining means similar to the latch arms 52, latch fingers 53, U-shaped brackets 54 and retaining fingers 56. However, for purposes of more clearly illustrating the remainder of the structure, the retaining means has been omitted from FIGS. 14–24.

One of the desirable modifications embodied in the barn section 100 is that the portion of the side walls which extends downwardly from the curing space 106 when the barn section 100 is disposed in its curing position has a vertical extent equal to the vertical extent previously embodied in the side walls 26 of the barn section 21 plus the vertical extent of the blocks 23. This enables the barn sections 100 to be mounted on a flat slab 124 as shown in FIG. 14 so that it is no longer necessary to provide for the blocks 23 as previously described.

Another modification which is illustrated in the barn section 100 is the basic connection of the top wall 104 to the side walls 102. Thus, instead of providing for the assembly of the side walls and top walls along a juncture line at the central ridge of the top wall section as previously described, in the present arrangement the top wall 104 is formed separately as a single unitary construction separate from each of the side walls. This enables the barn sections to be transported in a knocked down condition with the side walls stacked one on top of the other and the top walls in like condition. This arrangement provides for simplicity in the fabrication of the individual walls as well as facilitating the assembly of the walls into a section.

Figure 17:
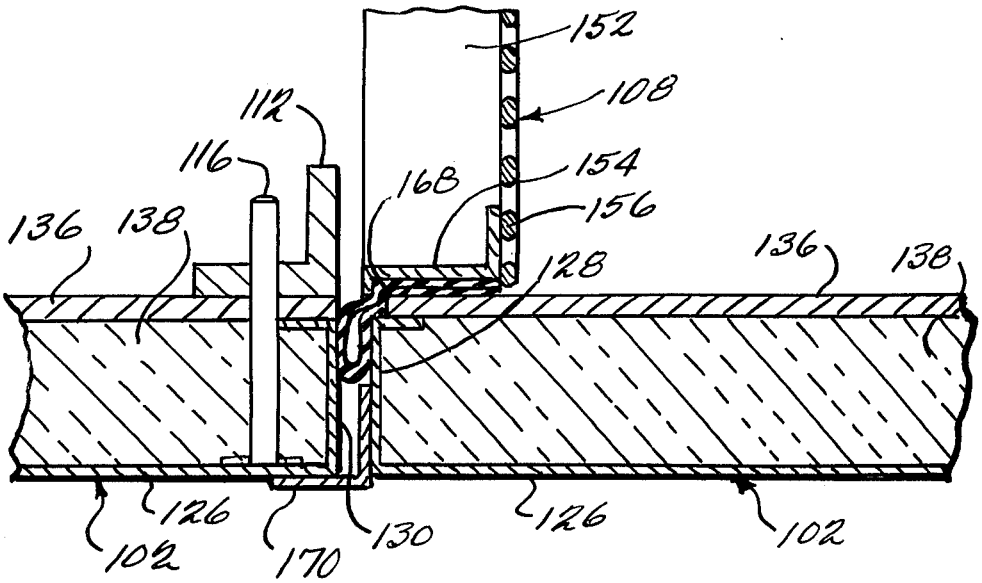
FIG. 17 is an enlarged fragmentary sectional view taken along the line 17—17 of FIG. 14.
Figure 16:
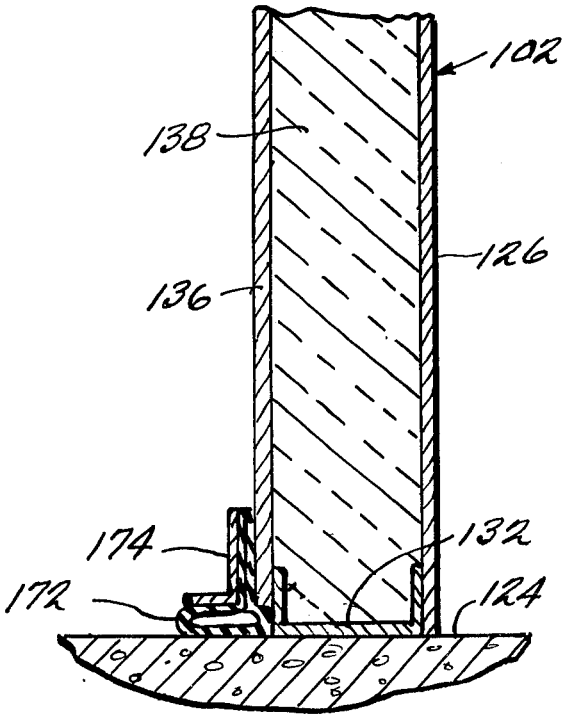
FIG. 16 is an enlarged fragmentary sectional view taken along the line 16—16 of FIG. 14.

Referring now more particularly to FIGS. 14–18, it will be noted that each of the side walls 102 is formed with an outer skin of sheet metal 126. As best shown in FIG. 17, opposite marginal edge portions of the sheet metal 126 are bent into a channel configuration so as to define opposite end edges 128 and 130 of the side walls 102 which are spaced apart horizontally when the barn section 100 is disposed in its curing position. As best shown in FIG. 16, the edge of each side wall 102 which engages the slab 124 when the barn section 100 is in its curing position, is formed by a channel 132 welded to the outer skin 126. As best shown in FIG. 15, the opposite end edge, which connects with the top wall 104, is formed by an elongated reinforced channel 134 which provides a hook configuration extending outwardly along the upper edge. Each side wall 102 also includes an interior layer 136 preferably in the form of a plywood sheet which is fixed to the legs of the channels provided along the edges as aforesaid. In this way, the exterior metal skin 126 is spaced from the interior plywood layer 136 and, if desired, suitable strengthening channels may also be provided (not shown). Disposed between the exterior metal skin 126 and the inner plywood layer 136 is an intermediate layer of insulating material 138 which may be either conventional insulating batts or foamed plastic.

Figure 18:
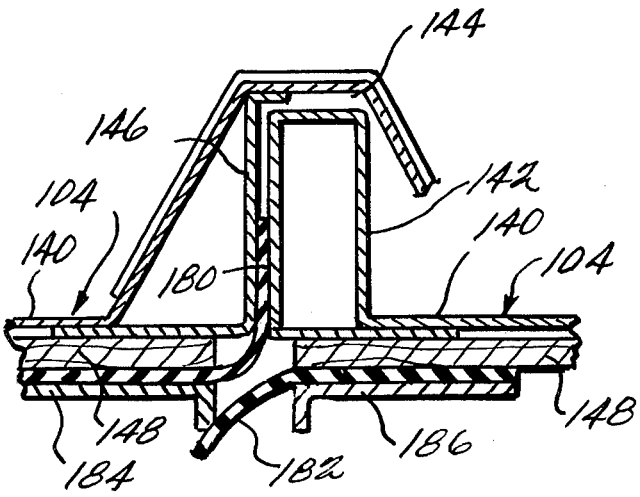
FIG. 18 is an enlarged fragmentary sectional view taken along the line 18—18 of FIG. 14.

The top wall 104 is of gabled configuration including a central exterior ridge and exterior flat surfaces extending outwardly and downwardly therefrom. The exteior surfaces of the top wall 104 are provided by an outer skin of sheet metal 140. As best shown in FIG. 18, one marginal edge portion of the sheet metal outer skin 140 of the top wall 104 is bent so as to provide an end edge in the form of an elongated tongue 142 which extends upwardly when the barn section 100 is disposed in its curing position. The opposite marginal edge portion of the metal skin 140 of the top wall is bent so as to provide an end edge in the form of an elongated groove 144 which opens downwardly when the barn section 100 is disposed in its curing position. As shown in FIG. 18, the elongated groove configuration 144 is preferably reinforced by an angle iron 146 suitably welded in the position shown. As shown in FIGS. 15 and 18, each top wall 104 is provided with an interior layer 148 of plywood which is similar to the plywood layer 136 of the side walls. However, in the arrangement shown, the plywood layer 148 is mounted directly on the interior of the outer sheet metal skin. It will be understood that the configuration may be similar to that provided in the side walls wherein the plywood layer is spaced from the outer metal skin and suitable insulation is provided therebetween.

The marginal edge portions of the sheet metal skin 140 extending between the edges 142 and 144 are bent into a downwardly and inwardly extending channel configuration, as best shown in FIG. 15, to provide a hook configuration 150 which cooperates with the hook configuration provided by the channel members 134 of the respective side walls 102. With this configuration it will be seen that each hooked edge construction 134 of each top wall 102 is adapted to be connected with the associated hooked edge construction 150 of the top wall 104 by first interengaging the hooked constructions with the side wall 102 extending at an angle greater than the angle of its final assembled position.

The bottom construction 108 serves to rigidly maintain the two side walls 102 in their final assembled position parallel with one another and in this regard it can be seen from FIG. 17 that the bottom construction 108 includes a plurality of parallel cross supports 152 similar to the cross supports 45 previously described which are spaced apart horizontally. The ends of the cross supports 152 are rigidly interconnected by angle irons 154 which extend vertically when the barn section 100 is disposed in its curing position. The bottom construction 108 also includes a screen 156 in the form of an expanded metal sheet similar to the screen 43 previously described. In addition to the rigidifying support provided by the bottom construction 108, the side walls 102 and top walls 104 are maintained in their assembled positions by other suitable bracing means which, as shown, includes a corner brace 158 between each side wall and the adjacent portion of the top wall and a central L-shaped brace structure 160. The brace structure 160 includes a first leg portion 162 having a bifurcated end 164 extending outwardly in a position beneath the interior ridge of the top wall when the barn section 100 is in its curing position. The leg portion 162 extends rearwardly along the interior surface of the central ridge of the top wall 104. The L-shaped brace construction 160 includes a second leg portion 166 which extends downwardly from the leg portion 162 secured to the top wall in inwardly spaced relation therewith so as to extend along the central interior surface of the screen 156 of the bottom construction 108. In this way, the rearward extent of the horizontal leg portion 162 and the adjacent extent of the leg portion 166 provide cooperable elements which are operable to enter the bifurcated end 164 on the adjacent barn section when the sections are assembled in row formation, as shown in FIG. 14.

Still referring to FIGS. 15–18, there is shown therein desirable modifications of the sealing means corresponding to the resilient gasket strip 64 previously described. As best shown in FIG. 17, the end edges 128 and 130 of the side wall 102 are sealed by means of a sealing strip 168 which is formed with a tubular sealing portion and a strap-like mounting portion extending therefrom. The portion of the strip 168 coextensive with the bottom construction 108 is mounted on each associated side wall 102 by securement between the member 154 of the bottom construction 108 and the adjacent surface of the plywood layer 136. The remaining portions of each strip 168 are secured to the plywood wall 136 by suitable angle irons (not shown) which serve the same function as the angle iron 154. It will be noted that the tubular portion of the sealing strip 168 extends from the edge 128 into a position to engage the end edge 130 of the adjacent barn section 100 as each barn section 100 is mounted in the row formation with respect to those already mounted therein. Preferably, the end edge 128 is provided with an angle iron 170 which provides an outwardly extending overlapping flap for the purpose of closing the exterior gap between the end edges 128 and 130.

As best shown in FIG. 16, along the end of each side wall 102 provided by the channel 132 there is provided a sealing strip 172 which is of a construction similar to the strip 168 previously described, which strip is secured along the surface of the plywood layer 136 by an appropriate angle iron 174. As best shown in FIG. 15, the juncture between each side wall 102 and top wall 104 is sealed by means of a sealing strip 176, which is also similar to the sealing strip 168, mounted along the interior of the plywood layer 136, as by an angle iron 178.

The sealing arrangement for the juncture between the adjacent top walls 104 is shown in FIG. 18. In this case flat sealing strips of resilient material 180 and 182 are mounted along each of the opposite marginal edges of the plywood layer 148. The strips are mounted in positions by appropriate angle irons 184 and 186 respectively. It will be understood that the strip 182 may be provided in two sections spaced apart centrally to accommodate the brace structure 160. The manner in which these seal arrangements cooperate with respect to the adjacent tongue and groove edge construction 142 and 144 is clearly illustrated in FIG. 18. While the particular sealing arrangements shown are preferred it will be understood that other suitable sealing arrangements may be utilized.

It will be understood that each of the barn sections 100 is provided with a channel 188 on the exterior surface thereof extending generally horizontally between the end edges 128 and 130, which channel is similar to the channel 34 previously described. Fixed to the lower surface of each channel 188 is a tapered guide bar 189 similar to the guide bar 37 previously described.

Referring now more particularly to FIGS. 19–24, there is shown therein a leaf compression limiting means, generally indicated at 190, which constitutes a desirable optional feature particularly useful when the leaves being cured are sand lugs or other leaves taken from a position near the bottom of the stalk. As previously indicated, sand lugs are much larger than top leaves and their moisture content is usually greater than the moisture content of the top leaves. The larger sand lug type leaves tend to be less springy in nature than the smaller top leaves. Consequently, when sand lugs are loaded within the curing space 106 in a container such as provided by the barn section 100, the leaves which are filled in the curing space initially and are supported directly on the bottom structure 108 become more and more compressed as the curing space is filled and all of the leaves are finally loaded into the curing space. As a result, it sometimes occurs that the leaves adjacent the bottom structure 108 which have been compacted by the weight of the leaves thereabove during loading tend to remain in this excessively compacted condition when the container 100 is moved into its curing position in row formation with the other barn section containers. There is therefore provided within the curing space 106 a vertical laminar section of leaves adjacent the bottom construction 108 which is considerably more dense than the layer of leaves along the top closure means of the curing space. Consequently, during the cure, air may pass more freely through the layers of leaves which are of a lesser bulk density tending to channelize therethrough and as the cure progresses and the leaves give up moisture to the curing air, the differential bulk density is increased and hence results in a layer of leaves adjacent the bottom structure failing to receive sufficient curing air to insure a proper cure. The compression limiting means 190 is provided for the purpose of preventing the weight of the upper leaves during the loading operation from providing an excessive compression on the leaves adjacent the bottom structure 108 so as to make the bulk density of all of the leaves within the curing space 106 more uniform and hence prevent the situation noted above.

Figure 23:
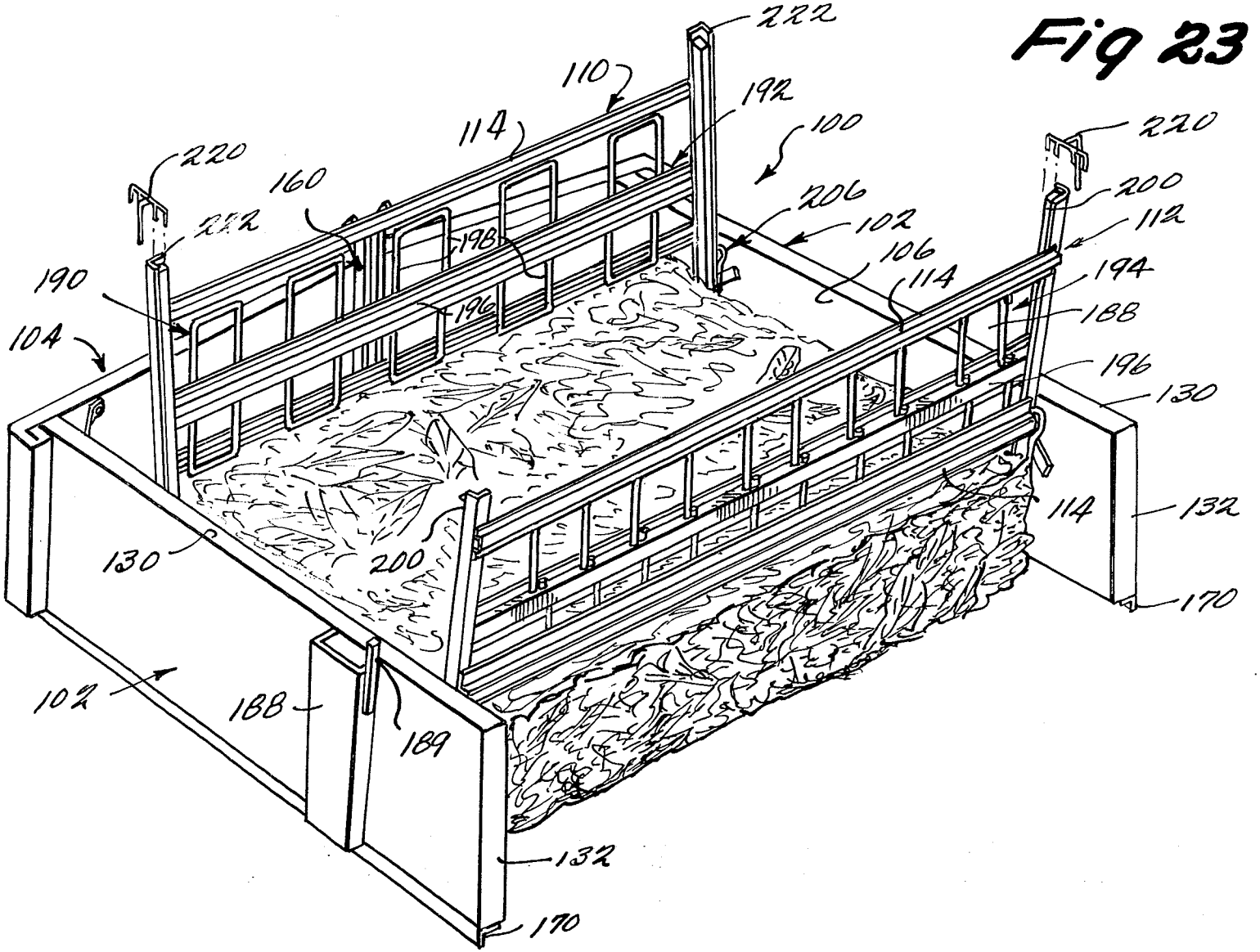
FIG. 23 is a perspective view of a barn section of the form shown in FIG. 14 illustrating the barn section in its loading position after an initial amount of leaves has been filled into the curing space thereof.
Figure 24:
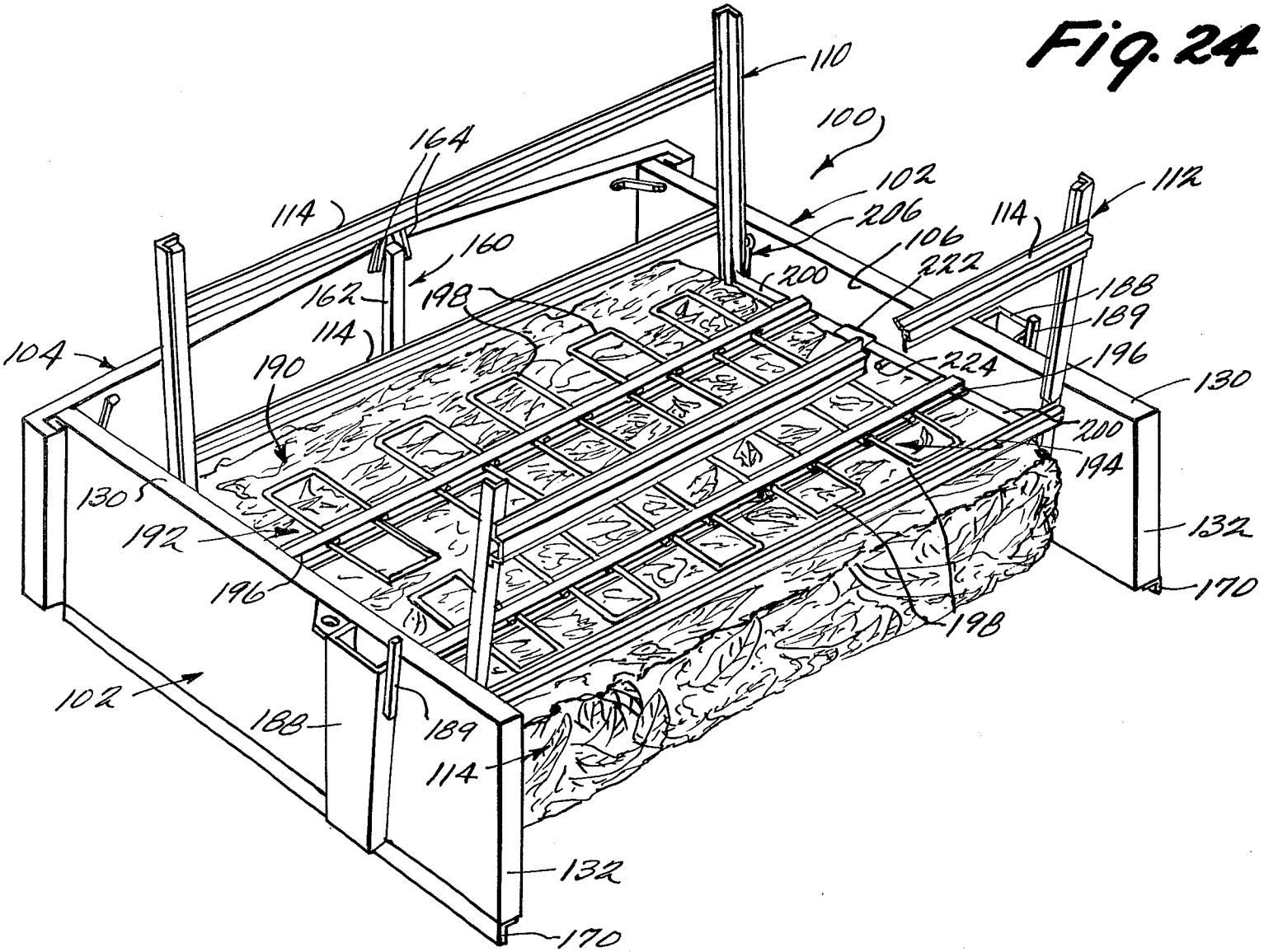
FIG. 24 is a view similar to FIG. 23 illustrating the condition of the barn section after the compression limiting open frame structures have been moved into their initial loaded position.

To this end, the compression limiting means 190 includes a pair of foraminous or open frame structures 192 and 194 which are slidably and pivotally mounted between the side walls 102 for movement from an open position, such as shown in FIG. 23 wherein the frame structures extend upwardly and outwardly from the ends of the curing space 106, into an operative loading position extending between the side walls in generally parallel relation to the bottom structure 108 and in overlying relation to an initial amount of leaves which has been loaded into the curing space, as shown in FIG. 24.

Figure 19:
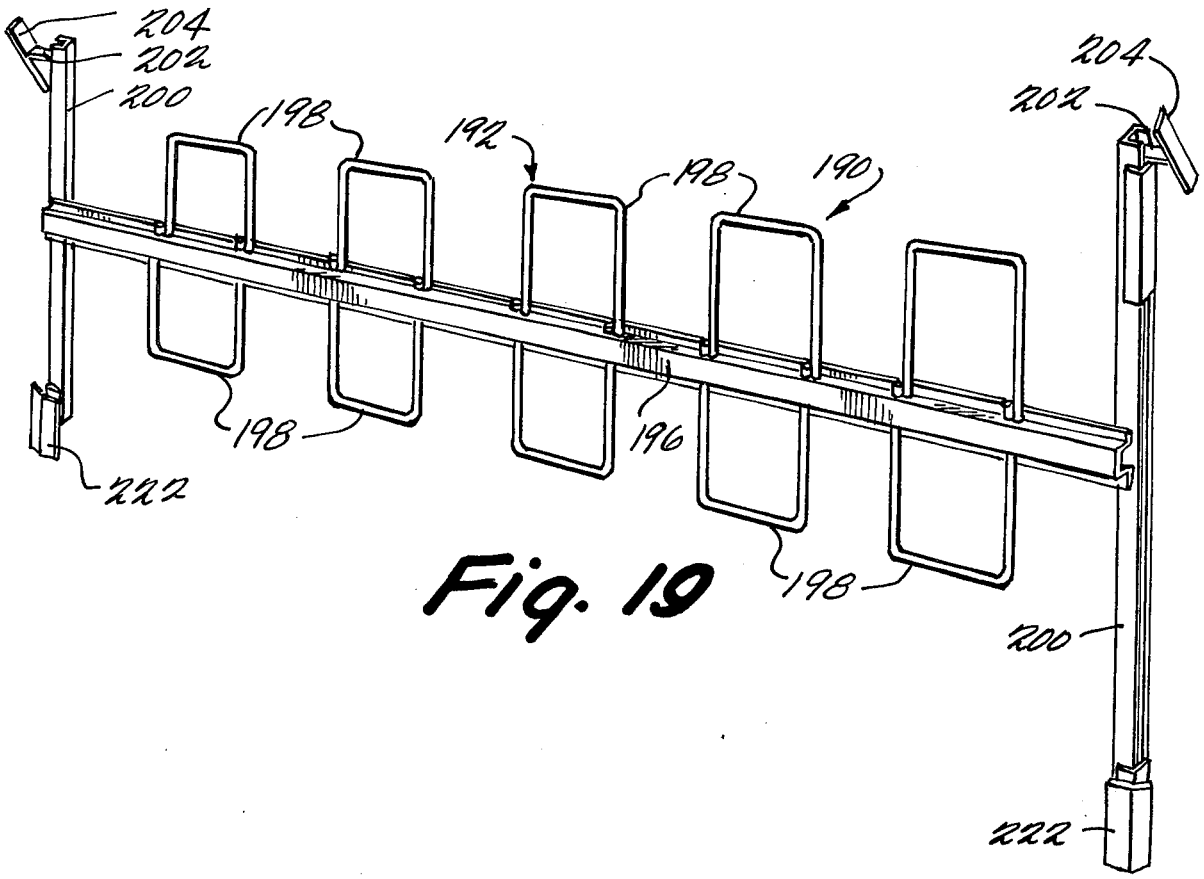
FIG. 19 is a perspective view of one of the compression limiting open frame structures.
Figure 20:
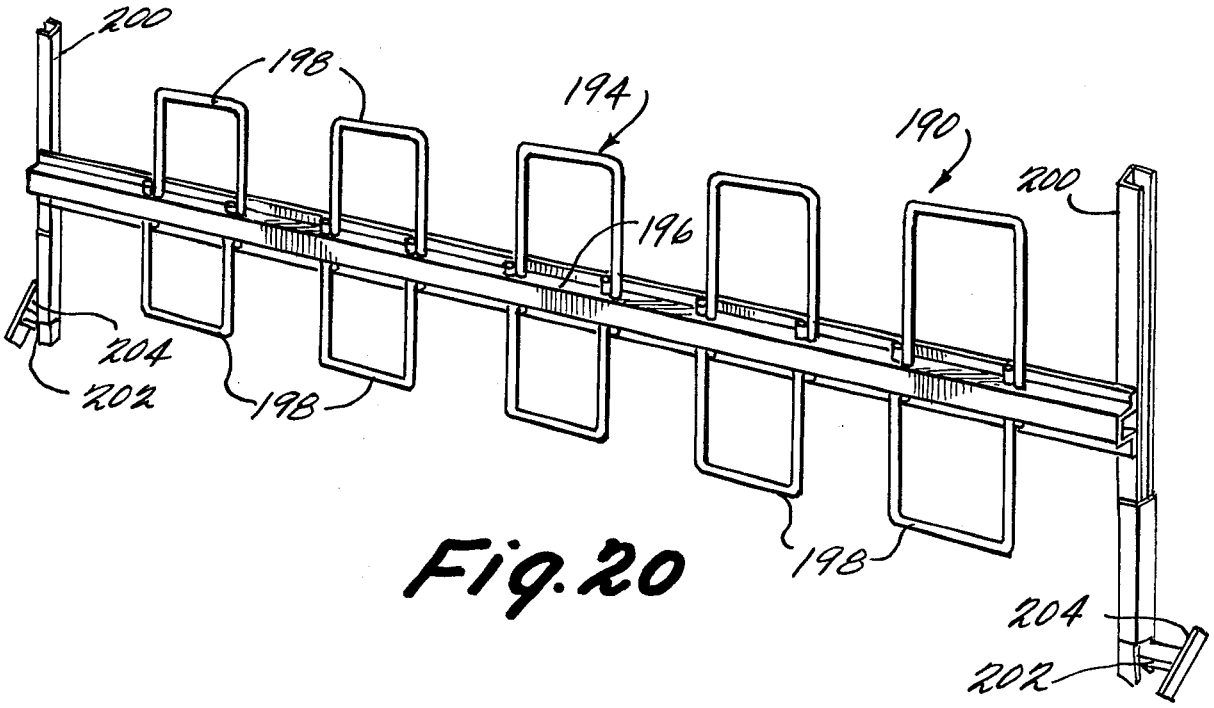
FIG. 20 is a perspective view of the other compression limiting open frame structure.

As best shown in FIGS. 19 and 20, each of the open-frame structures 192 and 194 includes an elongated flanged channel-shaped frame member 196. The leg portions of the frame member 196 are formed with a series of spaced openings for the reception of the free ends of the legs of a series of U-shaped rods 198. As shown there is provided a series of spaced U-shaped rods 198 extending from each side of the frame member 196. Each end of the frame member 196 is rigidly secured to the central portion of an angle iron forming a mounting arm 200. Extending laterally from one end of each arm 200 is a bar 202 of rectangular cross-sectional configuration. Fixed to the outer end of each bar 202 is a cross bar 204.

Figure 21:
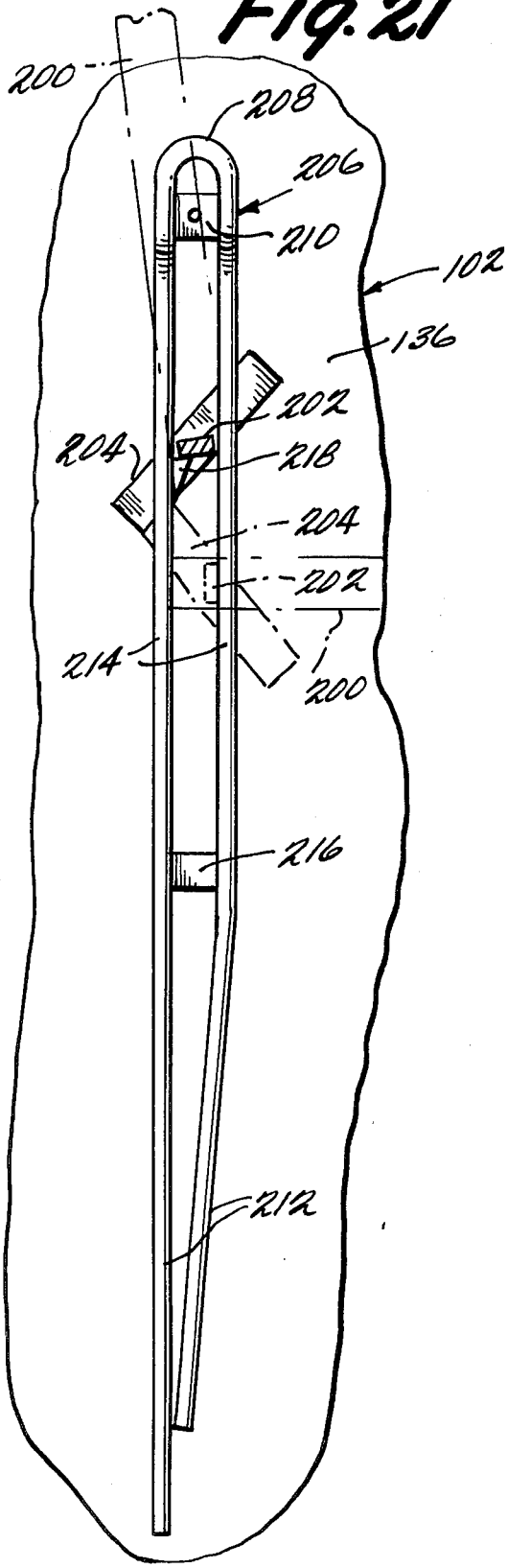
FIG. 21 is an enlarged fragmentary detailed view showing the mounting of one of the compression limiting open frame structures illustrating the same in solid lines in its open position and in dotted lines in an intermediate position between the open position and its initial loading position.
Figure 22:
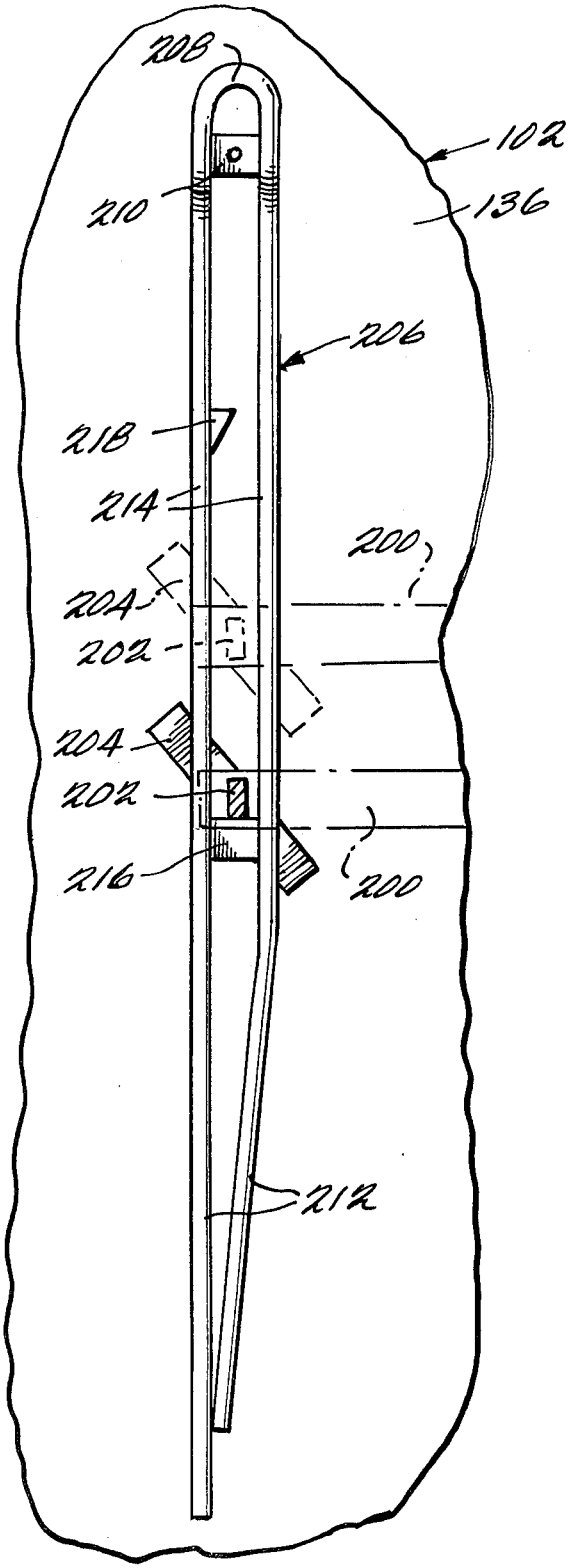
FIG. 22 is a view similar to FIG. 21 illustrating the position of the open frame structure in solid lines in its initial loading position and in dotted lines in its final loading position.

As best shown in FIGS. 21 and 22, each bar 202 is pivotally and slidably mounted to an adjacent interior of an associated side wall 102 by a mounting bracket assembly 206. Each mounting bracket assembly includes a rod having its central portion bent into a U-shaped form, as indicated at 208, and braced by a cross strap 210. The free end portions of the rod are formed into a tapered configuration indicated at 212. The intermediate portions of the rod between the U-shaped portion 208 and tapered portion 212 is displaced outwardly of the plane of the paper as shown in FIGS. 21 and 22 in a direction toward the viewer so as to provide two parallel central rod portions 214 which, when the portions 208 and 212 are disposed in abutting relation to the interior surface of the plywood layer 136, are spaced outwardly from the plywood surface as well as from one another. Fixed across the rod portions 214 adjacent the juncture thereof with the tapered portion 212 is a stop plate 216. Fixed to one of the rod portions 214 in a position intermediate the stop 210 and plate 216 is a triangularly shaped support block 218.

The extent of each cross bar 204 is such that it will fit between the stop plate 216 and block 218 of an associated mounting bracket assembly 206. Each open frame structure 192 and 194 is mounted between the side walls 102 by a pair of bracket assemblies 206 of the type shown in FIGS. 21 and 22 which are mirror images of one another. As mounted, the cross bars 204 of each frame structure are disposed between the adjacent surface of the plywood layer 136 and the rod portions 214 with the bars 202 extending between the associated rod portions 214. It will be noted that the rectangular cross-sectional configuration of the bar 202 is such that its long dimension will not pass downwardly between the rod portions 214 at the position of the block 218, whereas the narrow cross-sectional configuration of the bar will so pass. As shown in FIG. 21, the orientation of the cross-section of each bar 202 is such that when the bar is moved above the associated block 218 and pivoted so that its long cross-section extends between the rod portions 214, the associated mounting arm 200 extends upwardly as indicated in phantom lines in FIG. 21. In this way, the blocks 218 serve to provide support for the ends of the mounting arms 200 through the engagement of bars 202 therewith, as shown in full lines in FIG. 21. This position of the open frame sections 192 and 194 corresponds to the open position shown in FIG. 23. In this regard, it will be noted that a pair of retainer structures 220 is provided which cooperates with the upwardly extending ends of the mounting arms 200 as well as the associated mounting arms of the top closure assembly to retain the same in their open positions as shown in FIG. 23.

After an initial amount of leaves has been loaded within the curing space 106, which amount is equal to approximately one-half of the total leaves to be loaded therein, retainers 220 are removed and first the open frame structure 194 is moved upwardly and pivoted toward the center of the curing space 106, which movement aligns the narrow dimension of the cross-section of the bar 202 with the block 218 permitting the same to be moved downwardly past the block, as shown in dotted lines in FIG. 21. The open frame section 194 is then lowered into engagement with the surface of the leaves so as to reach a position generally indicated in dotted lines in FIG. 22 in which the bar 202 is spaced above the stop plate 216. It will be noted that open frame section 192 includes an extension 222 on the end of the mounting arms 200 opposite from the bars 202 and 204. The length of the extension is such that when the open frame structure 192 is moved into its intermediate position, the extensions 222 will overlie the adjacent ends of the mounting arms of the open frame structure 194. Fixed to each side wall at a level corresponding to the level of the stop plate 216 in a position to be engaged by the free end portion of each mounting arm 200 of the open frame structure 194 is a stop pin 224.

With this arrangement it will be noted that after the frame structures 192 and 194 have been moved into the dotted line position as shown in FIG. 22 in overlying relation to the initial amount of tobacco leaves loaded within curing space 106, the subsequent filling of tobacco leaves in the curing space 106 on top of the open frame structures 192 and 194 will cause the latter to move downwardly under the added weight. When the bars 202 engage stop plates 216 and the mounting arms 200 engage stop pins 224, further downward movement of the open frame structures 192 and 194 is prohibited and any further weight thereabove provided by the leaves ultimately loaded into the space 106 thereabove is borne by the frame structures 192 and 194 and not transmitted to the leaves therebelow. In this way the amount of compression which is transmitted to the lowermost leaves by the weight of the leaves thereabove is limited by the compression limiting means 190.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a tobacco bulk curing barn construction of the type including a furnace section having means for moving curing air from a first horizontally extending curing air space to a second horizontally extending curing air space so that the curing air will circulate vertically through a curing space communicating between said first and second curing air spaces, said furnace section including means for controlling the temperature of the curing air moving between said first and second curing air spaces and circulating through said curing space, the improvement wherein a curing part of said barn construction which defines said curing space and the upper one of said first and second curing air spaces is a composite part formed by a plurality of similarly constructed portable tobacco curing barn sections when disposed in similarly oriented curing positions and mounted in a row formation with respect to each other, each of said barn sections comprising a pair of opposed imperforate side walls spaced apart to provide components of exterior side walls of the composite curing part of the barn construction and an imperforate top wall connected to and extending between said side walls to provide a component of the exterior roof of the composite curing part of the barn construction, the side walls of each barn section when disposed in said curing position extending substantially the full height of the composite curing part of the barn construction and the top wall of each barn section when disposed in said curing position extending substantially the full width of the composite curing part of said barn construction, the major vertical extent of the interior of the side walls of said barn sections when mounted in said row formation defining the sides of said curing space, the interior of the top wall and the adjacent interior of the side walls disposed above the major vertical extent thereof defining said upper curing air space, the side and top walls of each of said barn sections having opposed sets of end edges spaced apart horizontally when the barn section is in its curing position, the opposite sets of end edges of adjacent barn sections when mounted in said row formation being sealingly interconnected so as to prevent the passage of air therebetween during the circulation of curing air within the curing air space and curing space provided therein, each of said barn sections having means on the exterior thereof enabling the same to be moved by a moving instrumentality from its curing position into a horizontal loading position wherein one set of the end edges of the side and top walls is disposed below the other set of end edges thereof, each of said barn sections having a bottom structure extending horizontally between the side walls thereof adjacent the one set of end edges thereof when said barn section is in said loading position to define a lower end of said curing space, the upper end of which is open so that tobacco can be filled downwardly into supported relation to said bottom structure and uniformly loaded within the curing space thereabove, and means engageable with the tobacco after the curing space of each barn section has been filled for supporting the tobacco loaded therein when said barn section is disposed in its curing position and mounted in said row formation.

2. The improvement as defined in claim 1 wherein said tobacco engaging means for each barn section comprises top closure means for securement between said side walls across the open upper end of said curing space after the tobacco has been filled therein to provide with said bottom structure and said side walls peripheral confinement for the tobacco, and tine means for extending through the tobacco in said curing space in a vertical direction when said barn section is disposed in said loading position and for extending in a horizontal direction when the barn section is moved into said curing position to provide internal support for the peripherally confined tobacco in said curing space during the curing operation.

3. The improvement as defined in claim 2 wherein the tine means for each barn section comprises a plurality of separate U-shaped tines, each of said U-shaped tines comprising a bight portion and a pair of generally parallel leg portions extending therefrom of a length sufficient to extend from said top closure means to said bottom structure, the free ends of the leg portions of said U-shaped tines being shaped to pierce completely through the tobacco peripherally confined in said curing space so as to be positioned adjacent the bottom structure when the associated bight portion is positioned adjacent said top closure means whereby when each barn section is moved from said loading position into said curing position said U-shaped tines are positioned to be supported and to provide interior support for the peripherally confined tobacco in the curing space during the curing operation.

4. The improvement as defined in claim 3 wherein each of said barn sections includes tobacco compression limiting means operable after an initial amount of tobacco has been filled into supported relation to said bottom structure between said side walls to be mounted in a tobacco engaging position extending horizontally across said curing space and over the initial amount of tobacco, and means connecting said tobacco compression limiting means when mounted in said tobacco engaging position to said side walls so as to prevent downward movement thereof toward said bottom structure beyond a fixed position and hence further compression of the initial amount of tobacco therebelow when further tobacco is subsequently filled downwardly into supported relation to said tobacco compression limiting means and finally compressed into said curing space.

5. The improvement as defined in claim 4 wherein said bottom structure of each barn section comprises a metal screen.

6. The improvement as defined in claim 5 wherein said bottom structure of each barn section further includes a plurality of rigid cross members extending between said side walls in engagement with the exterior surface of said metal screen.

7. The improvement as defined in claim 6 wherein said top closure means of each barn section includes cross supports extending between said side walls in staggered relation to said cross members for engagement of tobacco extending from the space of an adjacent barn section to prevent vertical voids interiorly between barn sections.

8. The improvement as defined in claim 7 wherein the end edges of each top wall are in the form of an elongated groove and an elongated tongue respectively, the interengaging sets of end edges of the top walls of each pair of adjacent barn sections when in said row formation constituting an upwardly extending elongated tongue cooperatively engaged within a downwardly opening elongated groove.

9. The improvement as defined in claim 4 wherein the top closure means of each barn section includes a pair of open frame structures mounted on said side walls for pivotal movement from the aforesaid position of securement between said side walls across the open upper end of said curing space into an open loading position wherein said frame structures diverge outwardly and upwardly with respect to one another from the open upper end of said curing space.

10. The improvement as defined in claim 9 wherein said tobacco compression limiting means of each barn section comprises a pair of rigid foraminous structures mounted on said side frames for pivotal and sliding movement from said fixed tobacco engaging position to an open loading position diverging outwardly and upwardly with respect to one another from the open upper end of said curing space.

11. The improvement as defined in claim 1 wherein said top wall and side walls of each barn section each include an exterior metal skin and an inner plywood layer.

12. The improvement as defined in claim 11 wherein said side walls of each barn section include a layer of insulating material between said exterior metal skin and said inner plywood layer.

13. The improvement as defined in claim 12 wherein each of said barn sections includes a rigid L-shaped brace having one leg portion extending along the central interior of said top wall and fixedly secured thereto and a second leg portion extending along the central interior of said bottom structure and fixedly secured thereto.

14. The improvement as defined in claim 1 wherein an end edge of each side wall of each barn section includes an elongated resilient tubular sealing element extending therealong to effect the aforesaid sealing interconnection thereof.

15. The improvement as defined in claim 1 wherein the movement enabling means of each barn section comprises a pair of channels, said channels being secured exteriorly to opposite side walls of the barn section for receipt of fork lift tines when said barn section is disposed in said curing position for lifting of said barn section by the fork lift tines and moving the barn section into and out of said row formation.

16. The improvement as defined in claim 1 wherein the top wall of each barn section is formed with an exterior gable configuration including a central ridge extending between opposite end edges thereof and slightly inclined flat surfaces diverging downwardly and outwardly therefrom, each of said flat surfaces terminating in a hooked edge construction detachably fixedly secured to a cooperating hooked edge construction formed on the associated side wall.

17. The improvement as defined in claim 1 wherein the interior of the side walls of each barn section disposed below the major vertical extent thereof defines the sides of the lower curing air space.

18. A container for receiving tobacco leaves while disposed in a horizontal loading position and for supporting the leaves for curing while disposed in a vertical curing position, said container when in said loading position comprising a horizontally extending bottom structure, a pair of side walls extending upwardly from said bottom structure in parallel relation with respect to one another, said bottom structure and said side walls defining curing space of a size comparable to a transverse section of a curing barn above said bottom structure and between said side walls which is open at the upper end thereof so that tobacco leaves can be filled downwardly in random fashion into supported relation to said bottom structure between said side walls and uniformly loaded into said curing space, tobacco leaf compression limiting means operable after an initial amount of tobacco leaves have been filled into supported relation to said bottom structure between said side walls to be mounted in a leaf engaging position extending horizontally across said curing space and over the initial amount of leaves, means connecting said leaf compression limiting means when mounted in said leaf engaging position to said side walls so as to prevent downward movement thereof toward said bottom structure beyond a fixed position and hence further compression of the initial amount of tobacco leaves therebelow when further tobacco leaves are subsequently filled downwardly into supported relation to said leaf compression limiting means and finally loaded into said curing space, top closure means for securement between said side walls across the open upper end of said curing space after the tobacco leaves have been loaded therein to provide with said bottom structure and said side walls peripheral confinement for the loaded tobacco leaves, and tine means for extending through the tobacco in said curing space in a vertical direction when said container is disposed in said loading position and for extending in a horizontal direction when said container is moved into said curing position to provide internal support for the peripherally confined leaves loaded into said curing space during the curing operation.

19. A container as defined in claim 18 wherein said tine means comprises a plurality of separate U-shaped tines, each of said U-shaped tines comprising a bight portion and a pair of generally parallel leg portions extending therefrom of a length sufficient to extend from said top closure means to said bottom structure, the free ends of the leg portions of said U-shaped, tines being shaped to pierce completely through the tobacco peripherally confined in said curing space so as to be positioned adjacent the bottom structure when the associated bight portion is positioned adjacent said top closure means whereby when each barn section is moved from said loading position into said curing position said U-shaped tines are positioned to be supported and to provide interior support for the peripherally confined tobacco in the curing space during the curing operation.

20. A container as defined in claim 18 wherein said bottom structure comprises a metal screen.

21. A container as defined in claim 20 wherein said bottom structure further includes a plurality of rigid cross members extending between said side walls in engagement with the exterior surface of said metal screen.

22. A container as defined in claim 21 wherein said top closure means includes cross supports extending between said side walls in staggered relation to said cross members.

23. A container as defined in claim 18 wherein said top closure means includes a pair of open frame structures mounted on said side walls for pivotal movement from the aforesaid position of securement between said side walls across the open upper end of said curing space into an open loading position wherein said frame structures diverge outwardly and upwardly with respect to one another from the open upper end of said curing space.

24. A container as defined in claim 18 wherein said tobacco compression limiting means comprises a pair of rigid foraminous structures mounted on said side frames or pivotal and sliding movement from said fixed tobacco engaging position to an open loading position diverging outwardly and upwardly with respect to one another from the open upper end of said curing space.

25. A container as defined in claim 18 wherein said side walls are imperforate and are interconnected by an imperforate transverse wall forming a roof spaced above the curing space between said side walls when said container is in said curing position.

26. A container as defined in claim 25 wherein each of said imperforate walls includes an exterior metal skin and an inner plywood layer.

27. A container as defined in claim 26 wherein said side walls include a layer of insulating material between the exterior metal skin and inner plywood layer thereof.

28. A container as defined in claim 25 including a rigid L-shaped brace having one leg portion extending along the central interior of said top wall and fixedly secured thereto and a second leg portion extending along the central interior of said bottom structure and fixedly secured thereto.

29. A container as defined in claim 25 wherein said transverse wall includes opposed end edges, one of said end edges being in the form of an elongated tongue which extends upwardly when said container is in said curing position, the other of said end edges being in the form of a downwardly opening elongated groove of a size to receive the elongated tongue.

30. A container as defined in claim 29 wherein said transverse wall is formed with an exterior gable configuration including a central ridge extending between the opposite end edges thereof and slightly inclined flat surfaces diverging downwardly and outwardly therefrom, each of said flat surfaces terminating in a hooked edge construction detachably fixedly secured to a cooperating hooked edge construction formed on the associated side wall.

31. A container as defined in claim 18 including a pair of channels, said channels being secured exteriorly to opposite side walls for receipt of fork lift tines when said container is disposed in said curing position for lifting of said container by the fork lift tines and moving the container.

32. A container as defined in claim 18 wherein an end edge of each side wall includes an elongated resilient tubular sealing element extending therealong.

33. A container for receiving tobacco leaves while disposed in a horizontal loading position and for supporting the leaves for curing while disposed in a vertical curing position, said container when in said loading position comprising a horizontally extending bottom structure, a pair of side walls extending upwardly from said bottom structure in parallel relation with respect to one another, said bottom structure and said side walls defining curing space of a size comparable to a transverse section of a curing barn above said bottom structure and between said side walls which is open at the upper end thereof so that tobacco leaves can be filled downwardly in random fashion into supported relation to said bottom structure between said side walls and uniformly loaded into said curing space, top closure means for securement between said side walls across the open upper end of said curing space after the tobacco leaves have been filled therein to provide with said bottom structure and said side walls peripheral confinement for the loaded tobacco leaves, and a plurality of separate U-shaped tines, each of said U-shaped tines comprising a bight portion and a pair of generally parallel leg portions extending therefrom of a length sufficient to extend from said top closure means to said bottom structure, the free ends of the leg portions of said U-shaped tines being shaped to pierce completely through the loaded tobacco leaves peripherally confined in said curing space so as to be positioned adjacent the bottom structure when the associated bight portion is positioned adjacent said top closure means whereby when said container is moved from said loading position into said curing position said U-shaped tines are positioned to be supported and to provide interior support for the peripherally confined tobacco leaves in the curing space during the curing operation.

34. A container as defined in claim 33 wherein said bottom structure comprises a metal screen.

35. A container as defined in claim 34 wherein said bottom structure further includes a plurality of rigid cross members extending between said side walls in engagement with the exterior surface of said metal screen.

36. A container as defined in claim 35 wherein said top closure means includes cross supports extending between said side walls in staggered relation to said cross members.

37. A container as defined in claim 33 wherein said top closure means includes a pair of open frame structures mounted on said side walls for pivotal movement from the aforesaid position of securement between said side walls across the open upper end of said curing space into an open loading position wherein said frame structures diverge outwardly and upwardly with respect to one another from the open upper end of said curing space.

* * * * *